US007988149B2

(12) United States Patent
Terada

(10) Patent No.: US 7,988,149 B2
(45) Date of Patent: Aug. 2, 2011

(54) SHEET CONVEYING DEVICE AND IMAGE RECORDING APPARATUS

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 260 days.

(21) Appl. No.: 12/393,722

(22) Filed: Feb. 26, 2009

(65) Prior Publication Data

US 2009/0218763 A1 Sep. 3, 2009

(30) Foreign Application Priority Data

Feb. 29, 2008 (JP) ..... 2008-049721
Feb. 29, 2008 (JP) ..... 2008-050055

(51) Int. Cl.
*B65H 5/02* (2006.01)

(52) U.S. Cl. ..... 271/272; 271/274; 271/277; 271/314

(58) Field of Classification Search ..... 271/272, 271/274, 314, 264, 277
See application file for complete search history.

(56) References Cited

U.S. PATENT DOCUMENTS 7,458,577 B2 * 12/2008 Terada ..... 271/273
2007/0075484 A1 4/2007 Terada
2007/0077080 A1 4/2007 Terada
2007/0145678 A1 6/2007 Terada
2007/0145679 A1 6/2007 Terada
2007/0228642 A1 10/2007 Terada

FOREIGN PATENT DOCUMENTS

JP S62-215454 A 9/1987
JP H07-214845 A 8/1995
JP 2007-090669 A 4/2007
JP 2007-091449 A 4/2007
JP 2007-175991 A 7/2007
JP 2007-176645 A 7/2007
JP 2007-261061 A 10/2007

OTHER PUBLICATIONS

Japan Patent Office; Office Action in Japanese Patent Application No. 2008-049721 (counterpart to the above-captioned U.S. patent application) mailed Apr. 27, 2010.

* cited by examiner

*Primary Examiner* — Stefanos Karmis
*Assistant Examiner* — Luis A Gonzalez
(74) *Attorney, Agent, or Firm* — Baker Botts L.L.P.

(57) ABSTRACT

A second support member supports a first support member so that the first support member is movable between a predetermined first position and a second position at an upstream side of the first position in a conveying direction of a recording medium. The first support member is moved to the first position during conveyance of the recording medium by a first conveying section. The first support-member is moved to the second position during non-conveyance of the recording medium by the first conveying section.

7 Claims, 14 Drawing Sheets

SHEET CONVEYING DEVICE AND IMAGE RECORDING APPARATUS

CROSS REFERENCE TO RELATED APPLICATION

The present application claims priority from Japanese patent applications No. 2008-049721 filed Feb. 29, 2008 and No. 2008-050055 filed Feb. 29, 2008. The entire contents of the priority applications are incorporated herein by reference.

TECHNICAL FIELD

The invention relates to a sheet conveying device that conveys a sheet-like recording medium. More particularly, the invention relates to a sheet conveying device configured to convey a recording medium with a conveying unit including a drive roller and a follow roller pressed against the drive roller, and to an image recording apparatus provided with the sheet conveying device.

BACKGROUND

Conventionally, an inkjet-type image recording apparatus is provided with a sheet conveying device that conveys a recording sheet toward a platen. The sheet conveying device includes a pair of conveying rollers arranged at the upstream side of the platen in the conveying direction (hereinafter abbreviated as "upstream side") and a pair of discharging rollers arranged at the downstream side of the platen in the conveying direction (hereinafter abbreviated as "downstream side").

When an image is recorded in the image recording apparatus, the pair of conveying rollers is driven intermittently for conveying the recording sheet intermittently by a predetermined length. During the stopped time of the intermittent conveyance, a recording head is slidingly moved in the direction perpendicular to the conveying direction of the recording sheet, while ink is ejected from the nozzles of the recording head so that ink adheres to the recording sheet. This operation is repeated for each intermittent conveyance, thereby continuously recording images with a predetermined length on the recording sheet. Note that a controller (not shown) controls the rotations of the pair of conveying rollers and the pair of discharging rollers, thereby performing the above-described intermittent conveyance.

The pair of conveying rollers includes a drive roller and a follow roller. The drive roller receives rotational force transmitted from a motor or the like, and is driven to rotate. The follow roller is urged by a coil spring or the like so as to be pressed against the drive roller, and followingly rotates.

SUMMARY

It is an object of the invention to provide a sheet conveying device capable of improving the quality of an image recorded on a recoding medium, and to provide an image recording apparatus provided with the sheet conveying device.

Another object of the invention is to provide a sheet conveying device capable of preventing conveyance malfunctions such as paper jam and oblique conveyance, and to provide an image recording apparatus provided with the sheet conveying device.

To achieve the above and other objects, one aspect of the invention provides a sheet conveying device that conveys a sheet-like recording medium to a support on which the recording medium is placed during image recording. The sheet conveying device includes a first conveying section, a rotation support member, a first guide member, a first support member, an urging member, and a second support member. The first conveying section has a drive roller and a follow roller arranged in confrontation with the drive roller. The first conveying section conveys a recording medium toward the support. The rotation support member rotatably supports the follow roller. The first guide member is provided to the rotation support member and protrudes toward the support. The first support member movably supports the rotation support member so that the follow roller can move toward and away from the drive roller. The urging member is disposed between the first support member and the rotation support member, and urges both the follow roller and the rotation support member toward the drive roller side. The second support member supports the first support member so that the first support member is movable between a predetermined first position and a second position at an upstream side of the first position in a conveying direction of the recording medium. The first support member is moved to the first position during conveyance of the recording medium by the first conveying section. The first support member is moved to the second position during non-conveyance of the recording medium by the first conveying section.

In another aspect of the present invention, there is provided a sheet conveying device that conveys a sheet-like recording medium in a predetermined conveying direction. The sheet conveying device includes a first conveying section, a rotation support member, a guide member, a first support member, a positioning member, an urging member, and a second support member. The first conveying section has a drive roller and a follow roller arranged in confrontation with the drive roller and is configured to followingly rotate while pressed against the drive roller. The rotation support member rotatably supports the follow roller. The guide member is provided integrally to the rotation support member. The guide member guides a recording medium so that the recording medium passes through a nip portion between the drive roller and the follow roller. The first support member movably supports the rotation support member so that the follow roller can move toward and away from the drive roller. The positioning member is provided integrally to the first support member. The positioning member positions a shaft of the follow roller with respect to the conveying direction. The urging member is disposed between the first support member and the rotation support member, and urges the rotation support member toward the drive roller side. The second support member supports the first support member so that the first support member is movable between a predetermined first position and a second position at an upstream side of the first position in a conveying direction of the recording medium. The first support member is moved to the first position during conveyance of the recording medium by the first conveying section. The first support member is moved to the second position during non-conveyance of the recording medium by the first conveying section.

In another aspect of the present invention, there is provided an image recording apparatus including a sheet conveying device and a recording head. The sheet conveying device conveys a sheet-like recording medium to a support on which the recording medium is placed during image recording. The sheet conveying device includes a first conveying section, a rotation support member, a first guide member, a first support member, an urging member, and a second support member. The first conveying section has a drive roller and a follow roller arranged in confrontation with the drive roller. The first conveying section conveys a recording medium toward the support. The rotation support member rotatably supports the follow roller. The first guide member is provided to the rotation support member and protrudes toward the support. The first support member movably supports the rotation support member so that the follow roller can move toward and away from the drive roller. The urging member is disposed between the first support member and the rotation support member, and urges both the follow roller and the rotation support member toward the drive roller side. The second support member supports the first support member so that the first support member is movable between a predetermined first position and a second position at an upstream side of the first position in a conveying direction of the recording medium. The first support member is moved to the first position during conveyance of the recording medium by the first conveying section. The first support member is moved to the second position during non-conveyance of the recording medium by the first conveying section. The recording head performs image recording by an inkjet recording method onto a recording medium that is conveyed by the sheet conveying device.

In another aspect of the present invention, there is provided an image recording apparatus including a sheet conveying section and a recording head. The sheet conveying device conveys a sheet-like recording medium in a predetermined conveying direction. The sheet conveying device includes a first conveying section, a rotation support member, a guide member, a first support member, a positioning member, an urging member, and a second support member. The first conveying section has a drive roller and a follow roller arranged in confrontation with the drive roller and is configured to followingly rotate while pressed against the drive roller. The rotation support member rotatably supports the follow roller. The guide member is provided integrally to the rotation support member. The guide member guides a recording medium so that the recording medium passes through a nip portion between the drive roller and the follow roller. The first support member movably supports the rotation support member so that the follow roller can move toward and away from the drive roller. The positioning member is provided integrally to the first support member. The positioning member positions a shaft of the follow roller with respect to the conveying direction. The urging member is disposed between the first support member and the rotation support member, and urges the rotation support member toward the drive roller side. The second support member supports the first support member so that the first support member is movable between a predetermined first position and a second position at an upstream side of the first position in a conveying direction of the recording medium. The first support member is moved to the first position during conveyance of the recording medium by the first conveying section. The first support member is moved to the second position during non-conveyance of the recording medium by the first conveying section. The recording head performs image recording by an inkjet recording method onto a recording medium that is conveyed by the sheet conveying device.

BRIEF DESCRIPTION OF THE DRAWINGS

In the drawings:

FIGS. 8A and 8B are partial enlarged cross-sectional views for illustrating the moving range of the pinch roller holder, wherein FIG. 8A shows a state where the pinch roller holder is located at a retracted position (second position), and FIG. 8B shows a state where the pinch roller holder is located at a conveying position (first position);

FIGS. 9A and 9B are cross-sectional views showing the pair of conveying rollers when recording sheets are conveyed, wherein FIG. 9A shows a state where a thin recording sheet is pinchingly conveyed, and FIG. 9B shows a state where a thick recording sheet is pinchingly conveyed;

DETAILED DESCRIPTION

A sheet conveying device and an image recording apparatus according to an embodiment of the invention will be described while referring to the accompanying drawings. Note that the embodiment described below is merely an example embodying the invention, and it would be apparent to those skilled in the art that various changes and modifications may be made therein without departing from the spirit of the invention.

<Overall Configuration of Multifunction Apparatus 1>

Figure 1:
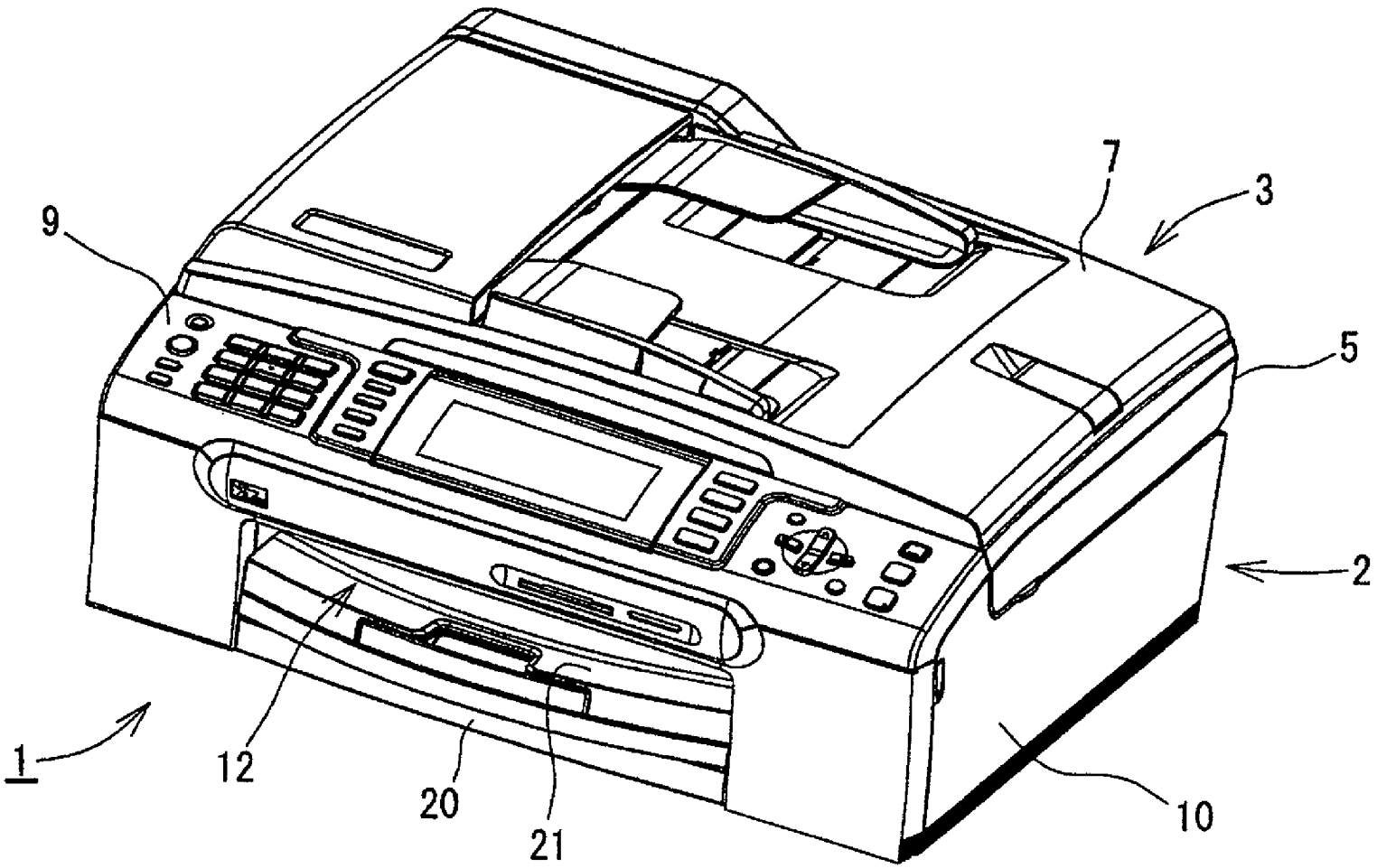
FIG. 1 is a perspective view showing the exterior of a multifunction apparatus according to an embodiment of the invention.

As shown in FIG. 1, the multifunction apparatus 1 according to the present embodiment is integrally provided with a printer section 2 of inkjet recording type (an example of the image recording apparatus of the invention) provided at the lower part of the multifunction apparatus 1, and a scanner section 3 provided at the upper side of the printer section 2. The multifunction apparatus 1 has a printer function, a scanner function, a copier function, a facsimile function, and the like. The sheet conveying device of the invention is embodied as a mechanism that conveys a recording sheet (recording medium) to an image recording position in the printer section 2. In the present embodiment, the multifunction apparatus 1 having a plurality of functions is described. However, for example, a so-called printer including only the printer section 2 may be implemented as the image recording apparatus of the invention.

The printer function is a function of the printer section 2 that records images and texts on a recording sheet based on image data and text data transmitted from a computer (not shown). The scanner function is a function of transferring image data of an original scanned by the scanner section 3 to a computer connected with the scanner section 3 in a wired or wireless manner. The scanned image data can be transferred to various storage media such as a memory card and stored therein. The copier function is a function of the printer section 2 that records image data scanned by the scanner section 3 on a recording sheet. The facsimile function is a function of transmitting image data scanned by the scanner section 3 via a telephone line or the like. Received facsimile data are recorded on a recording sheet by the printer section 2.

As shown in FIG. 1, the exterior of the multifunction apparatus 1 is formed as a substantially wide and low-profile rectangular parallelepiped in which the width and depth are larger than the height. The printer section 2 at the lower part of the multifunction apparatus 1 includes a casing 10 constituting the frame of the printer section 2. An opening 12 is formed in the front surface of the casing 10. Inside the opening 12, a sheet supplying tray 20 and a sheet discharging tray 21 are arranged in upper and lower two stages, wherein the sheet supplying tray 20 accommodates recording sheets, and recording sheets on which images have been recorded are discharged onto the sheet discharging tray 21. A refill unit is provided within the casing 10, and ink cartridges storing ink are detachably mounted in the refill unit. Note that the refill unit and the ink cartridges are housed within the casing 10, and are not shown in FIG. 1.

An operation panel 9 for operating the printer section 2 and the scanner section 3 is provided on the front upper part of the multifunction apparatus 1. The operation panel 9 includes various operation buttons and a liquid crystal display arranged appropriately. The multifunction apparatus 1 is operated according to instructions (instruction signals) inputted from the operation panel 9. If the multifunction apparatus 1 is connected to an external computer, the multifunction apparatus 1 is also operated according to instructions (instruction signals) transmitted from the computer via a printer drive or a scanner driver.

The scanner section 3 includes an original scanner 5 functioning as a so-called flatbed scanner (FBS). An original cover 7 is provided to the original scanner 5 via a hinge at the rear side of the apparatus, so that the original cover 7 can open and close. A contact glass is provided at the upper part of the original scanner 5. An original as a scanning object is placed on the contact glass. A CIS (Contact Image Sensor) is provided below the contact glass. The CIS operates in such a manner that the depth direction of the multifunction apparatus 1 is the main scanning direction, and is movable reciprocatingly in the width direction of the multifunction apparatus 1. The scanner section 3 can be arbitrarily configured in the invention and is not related directly to the invention. Hence, detailed descriptions for the scanner section 3 are omitted herein.

<Overall Configuration of Printer Section 2>

Figure 2:
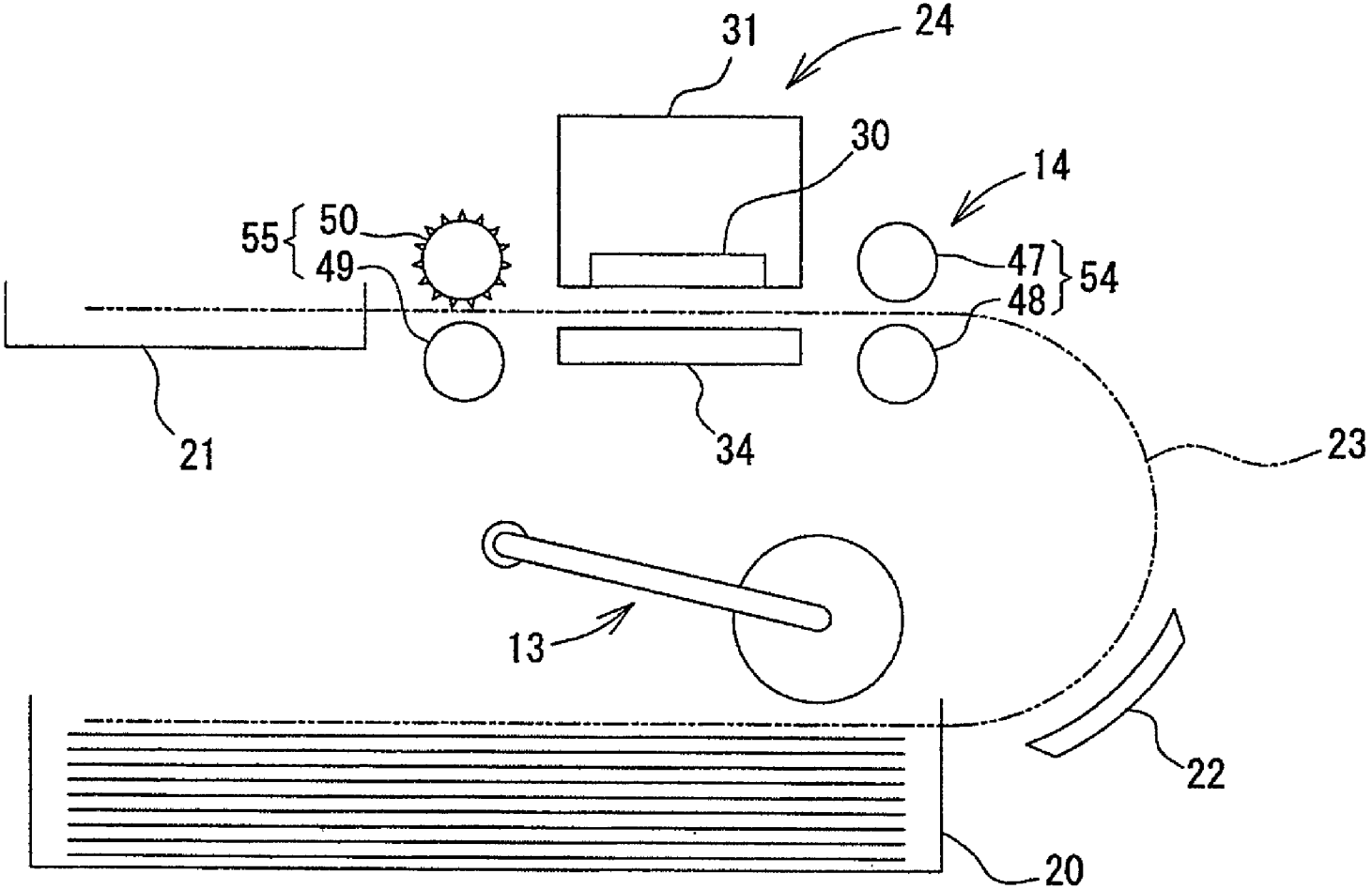
FIG. 2 is a schematic cross-sectional view schematically showing the internal structure of the multifunction apparatus shown in FIG. 1.

The printer section 2 records images on a recording sheet according to an inkjet recording method. The printer section 2 of the embodiment records color or monochromatic images on a recording sheet by using ink in four colors, that is, ink in each color of cyan (C), magenta (M), yellow (Y), and black (Bk). As shown in FIG. 2, the printer section 2 includes a sheet supplying device 13, a conveying device 14, and an image recording unit 24.

The sheet supplying tray 20 is provided at the bottom part of the printer section 2. The sheet supplying tray 20 accommodates a plurality of recording sheets in a stacked manner. The recording sheets stacked in the sheet supplying tray 20 are picked up by the sheet supplying device 13 one sheet at a time and is supplied to a sheet conveying path 23.

A separation slant plate 22 is provided at the rear side (the right side in FIG. 2) of the sheet supplying tray 20. The separation slant plate 22 is slanted toward the rear side of the apparatus. The separation slant plate 22 functions to separate recording sheets fed from the sheet supplying tray 20 and to guide one sheet upward. The sheet conveying path 23 is formed from the separation slant plate 22 toward the upper side. The sheet conveying path 23 is formed as substantially a U-shape rotated sideways when viewed in cross-section. More specifically, the sheet conveying path 23 extends upward from the separation slant plate 22, curves leftward to extend from the rear side toward the front side of the multifunction apparatus 1, passes through the image recording unit 24, and leads to the sheet discharging tray 21. Accordingly, a recording sheet accommodated in the sheet supplying tray 20 is guided to make a U-turn from the lower part to the upper part along the sheet conveying path 23, and reach the image recording unit 24. Then, after image recording is performed by the image recording unit 24, the recording sheet is discharged onto the sheet discharging tray 21.

As shown in FIG. 2, the image recording unit 24 is provided on the sheet conveying path 23. The image recording unit 24 includes a inkjet recording head 30 (hereinafter abbreviated as "recording head") and a carriage 31 supporting the recording head 30 and movable reciprocatingly in the main scanning direction (the direction perpendicular to the drawing surface of FIG. 2). The recording head 30 is supplied with ink in each color of cyan (C), magenta (M), yellow (Y), and black (Bk) from ink cartridges disposed within the printer section 2 via ink tubes 33 (see FIG. 4), and selectively ejects ink in each color as minute ink droplets. Ink droplets are selectively ejected from the recording head 30 while the carriage 31 is moved reciprocatingly, allowing image recording to be performed on a recording sheet conveyed along a platen 34.

Figure 4:
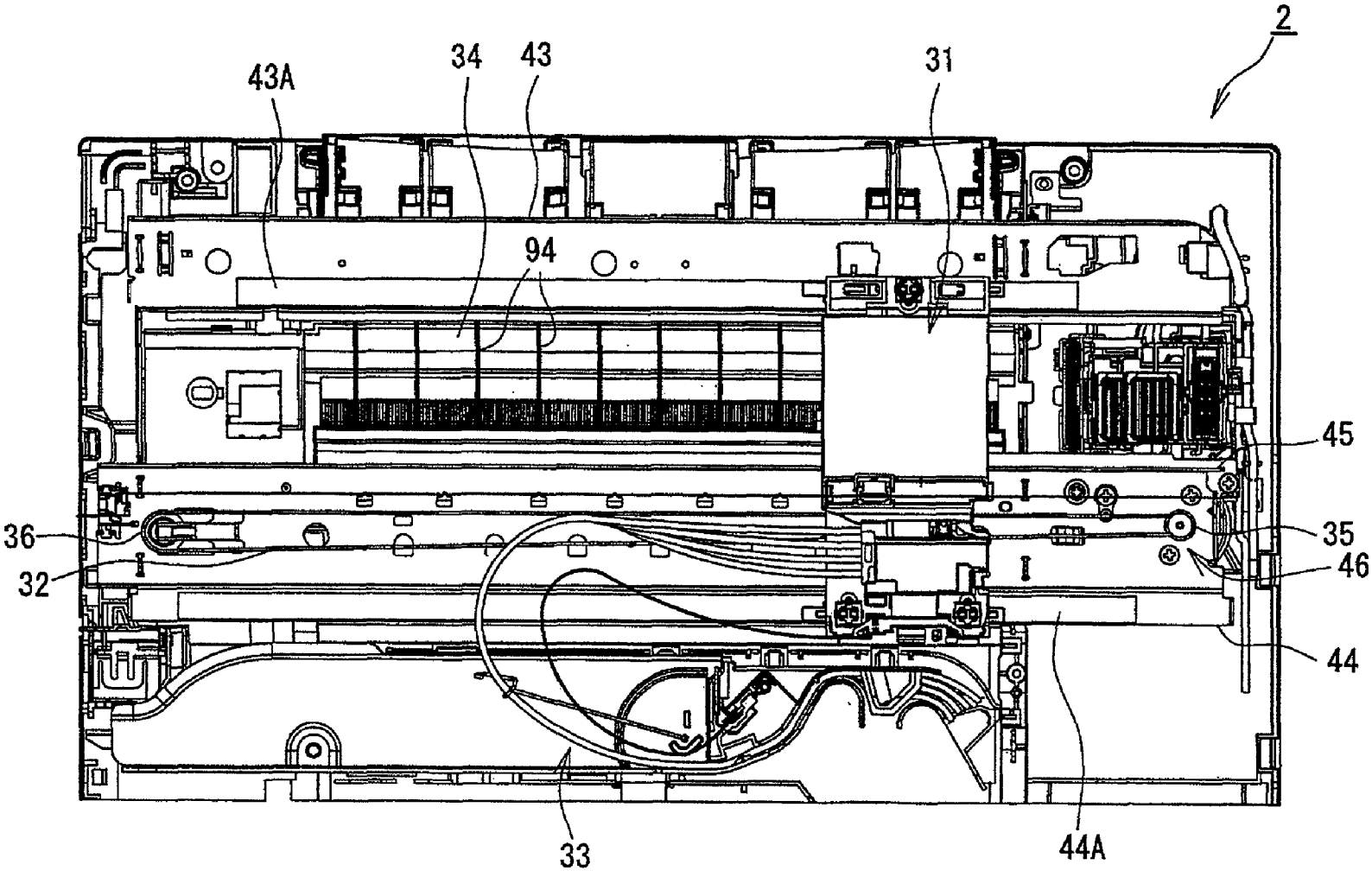
FIG. 4 is a plan view showing the main configuration of a printer section.

As shown in FIG. 4, a pair of guide rails 43 and 44 are provided within the printer section 2. The guide rails 43 and 44 extend in a direction (the left-right direction in FIG. 4) perpendicular to the conveying direction of recording sheets (the up-down direction in FIG. 4). The pair of guide rails 43 and 44 are arranged above the sheet conveying path 23 with a predetermined distance therebetween in the conveying direction of recording sheets. The carriage 31 is provided in such a manner the carriage 31 straddles the guide rails 43 and 44. The carriage 31 is movable in the horizontal direction perpendicular to the conveying direction of recording sheets. The guide rail 43 is arranged at the upstream side in the conveying direction of recording sheets (hereinafter abbreviated as "upstream side"). The guide rail 43 is a plate-shaped member of which length in the width direction of the sheet conveying path 23 is longer than the reciprocating range of the carriage 31. A guide surface 43A is the upper surface of the guide rail 43 at the downstream side in the conveying direction (hereinafter abbreviated as "downstream side"). The guide surface 43A slidably supports the upstream-side end of the carriage 31.

The guide rail 44 is a plate-shaped member of which length in the width direction of the sheet conveying path 23 is approximately the same as the guide rail 43. The guide rail 44 has an upstream-side edge section 45 that is bent upward at an approximately right angle. A guide surface 44A is the upper surface of the guide rail 44 at the downstream side. The guide surface 44A slidably supports the downstream-side end of the carriage 31. The carriage 31 clippingly grips the edge section 45 with rollers or the like (not shown). With this arrangement, the carriage 31 is slidably supported on the guide surfaces 43A and 44A of the guide rails 43 and 44. The carriage 31 is movable reciprocatingly in the horizontal direction perpendicular to the conveying direction of recording sheets, with the edge section 45 of the guide rail 44 as the reference.

A belt drive mechanism 46 is provided along the guide rail 44 on the upper surface of the guide rail 44. The belt drive mechanism 46 includes a drive pulley 35, a follow pulley 36, and a timing belt 32. The drive pulley 35 and the follow pulley 36 are provided near the both ends of the sheet conveying path 23 in the width direction, respectively. The timing belt 32 is an endless belt having teeth at the inner side, and is looped around the drive pulley 35 and the follow pulley 36. The shaft of the drive pulley 35 is connected to the rotational shaft of a motor (not shown). The motor inputs driving force to the shaft of the drive pulley 35, which rotates the drive pulley 35 so that the timing belt 32 circularly moves. Because the carriage 31 is connected to the timing belt 32, the carriage 31 reciprocatingly moves along the guide rails 43 and 44 with the edge section 45 as the reference, based on the operation of the belt drive mechanism 46. Further, because the recording head 30 is mounted on the carriage 31, the recording head 30 is movable reciprocatingly in the width direction of the sheet conveying path 23, which is the main scanning direction.

Figure 3:
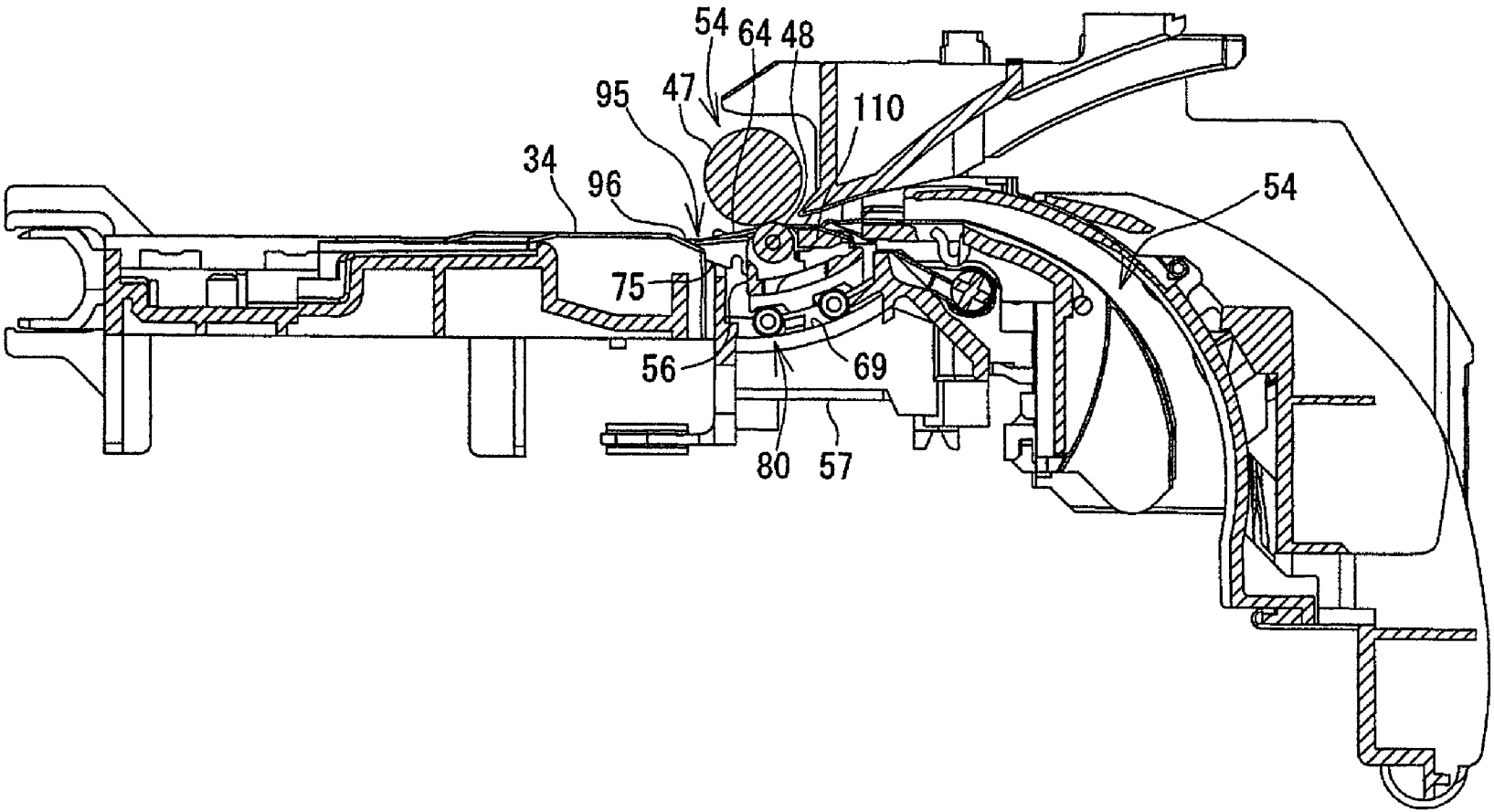
FIG. 3 is a partial cross-sectional view showing a pair of conveying rollers and its peripheral structure.

As shown in FIGS. 2 through 4, the platen 34 is provided at the lower side of the sheet conveying path 23 and is arranged in confrontation with the recording head 30. The platen 34 includes a plurality of ribs 94 standing upward vertically from its bottom plate. The ribs 94 are narrow plate-shaped members each extending in the conveying direction of recording sheets (the up-down direction of FIG. 4). The ribs 94 are provided at a plurality of positions with predetermined intervals therebetween in the width direction of the apparatus (the direction perpendicular to the conveying direction). The ribs 94 extend to the upstream-side end of the platen 34. In FIG. 4, the ribs 94 are formed in approximately the entire region of the upper surface of the platen 34. However, the ribs 94 may be formed only at the upstream-side end of the platen 34, for example.

The top surface of the platen 34, that is, the surface formed by the apex portions of the plurality of ribs 94 serves as the support surface of a recording sheet. A recording sheet conveyed to the platen 34 is supported by the apex portions of the plurality of ribs 94. The top surface of the platen 34 (the support surface) is formed horizontally. Thus, the recording sheet conveyed to the platen 34 is supported horizontally. The platen 34 is provided over the center part of the reciprocating range of the carriage 31 where a recording sheet passes. The width of the platen 34 is sufficiently larger than the width of the widest recording sheet that can be conveyed, so that the both ends of the recording sheet always pass on the platen 34.

As shown in FIG. 3, a sloped surface 96 is formed at an upstream-side end 95 of each rib 94. The sloped surface 96 is sloped downward from the apex portion of the rib 94 toward the upstream side, wherein a recording sheet is supported on the apex portion. The sloped surface 96 functions to smoothly guide the leading edge of a recording sheet conveyed to the platen 34 toward the top surface of the platen 34.

As shown in FIG. 2, the conveying device 14 is provided on the sheet conveying path 23. The conveying device 14 includes a pair of conveying rollers 54 and a pair of discharging rollers 55. The pair of conveying rollers 54 is arranged at the upstream side of the image recording unit 24. The pair of discharging rollers 55 is arranged at the downstream side of the pair of conveying rollers 54 and further downstream of the image recording unit 24. FIG. 3 shows the structure of the pair of conveying rollers 54 and other components in cross-section. Note that the image recording unit 24, the casing 10, the pair of discharging rollers 55, and the like are omitted in FIG. 3.

The pair of conveying rollers 54 includes a drive roller 47 and a pinch roller 48 disposed in confrontation with the drive roller 47. In the present embodiment, the pinch roller 48 is disposed at the lower side of the drive roller 47. As shown in FIG. 3, the pinch roller 48 is rotatably supported by a pinch roller holder 56 and an auxiliary holder 110. The support mechanism of the pinch roller 48 will be described in greater detail later. In the present embodiment, the pinch roller 48 is supported so that the pinch roller 48 elastically presses against the drive roller 47 with predetermined urging force. Thus, the pinch roller 48 is pressed against the drive roller 47. When a recording sheet enters the nip portion between the drive roller 47 and the pinch roller 48, the pinch roller 48 retracts downward by the amount equal to the thickness of the recording sheet and nippingly holds the recording sheet in cooperation with the drive roller 47. With this arrangement, the rotational force of the drive roller 47 is transmitted to the recording sheet S reliably. The recording sheet is conveyed toward the platen 34 while being nippingly held by the drive roller 47 and the pinch roller 48.

In the present embodiment, the pinch roller holder 56 is supported by a holder support member 57 attached to an inner frame constituting the casing 10 of the apparatus, so that the pinch roller holder 56 can be moved in the conveying direction of recording sheets. By adopting such a rolling-movement support mechanism, when the leading edge of a recording sheet enters the nip portion of the pair of conveying rollers 54, the pinch roller holder 56 moves, together with the pinch roller 48, from a retracted position (second position) at the upstream side shown in FIG. 8A to a conveying position (first position) at the downstream side shown in FIG. 8B. Further, when the trailing edge of the recording sheet separates from the nip portion of the pair of conveying rollers 54, the pinch roller holder 56 moves, together with the pinch roller 48, from the conveying position at the downstream side to the retracted position at the upstream side. Note that the structure of the holder support member 57 and the pinch roller holder 56, the support mechanism of the pinch roller holder 56 and the pinch roller holder 56, and the mechanism of rolling movement of the pinch roller holder 56 will be described in greater detail later.

In the present embodiment, the drive roller 47 and the pinch roller 48 are arranged in such a manner that the nip portion between the drive roller 47 and the pinch roller 48 is located at an upper position than the top surface of the platen 34, so that the pair of conveying rollers 54 can convey a recording sheet from the oblique upper side while pressing the recording sheet against the top surface of the platen 34. Further, the pinch roller 48 is located at the upstream side of the drive roller 47, regardless of the rolling position of the pinch roller holder 56 to be described later.

The pair of discharging rollers 55 includes a drive roller 49 and a spur roller 50. The spur roller 50 is provided above and in confrontation with the drive roller 49. The spur roller 50 is pressed against the drive roller 49. The drive roller 49 and the spur roller 50 nip the recording sheet on which recording has been performed, and convey the recording sheet toward the further downstream side. Like the pinch roller 48, the spur roller 50 is urged toward the drive roller 49 so that the spur roller 50 can be pressed against the drive roller 49. However, because the spur roller 50 makes pressure contact with the recording sheet on which recording has been performed, the roller surface of the spur roller 50 is formed like a spur shape with concavities and convexities, so as not to degrade the image recorded on the recording sheet.

A pulley is connected to one end of the drive roller 47 in the axial direction. The driving force of the motor is transmitted to the pulley, thereby rotating the drive roller 47. In addition, the driving force is transmitted from the above-mentioned pulley of the drive roller 47 via a transmission mechanism (not shown), thereby rotating the drive roller 49. Accordingly, the rotations of each of the drive rollers 47 and 49 are synchronized. Further, the outer diameters of each of the drive rollers 47 and 49 are the same size. Hence, each roller rotates with the same circumferential velocity.

In the present embodiment, the rotational position and the number of rotations of the drive roller 47 is monitored by a rotary encoder (not shown) connected to an end of the drive roller 47. The rotation of the above-mentioned motor is controlled based on detection signals of the rotary encoder, allowing the drive roller 47 and the drive roller 49 to be rotated continuously or intermittently. With this operation, a recording sheet can be conveyed continuously, or can be conveyed intermittently by predetermined linefeed width, as appropriate. Note that the rotary encoder can include, for example, an encoder disk provided to the drive roller 47 and a photo interrupter provided in confrontation with the encoder disk.

When a recording sheet is conveyed to the platen 34, the pair of conveying rollers 54 conveys the recording sheet on and along the platen 34 intermittently by predetermined linefeed width. Each time the linefeed is done, the recording head 30 is scanningly moved so that image recording is performed from the leading edge side of the recording sheet. The drive roller 49 and the spur roller 50 of the pair of discharging rollers 55 nippingly hold the leading edge side of the recording sheet on which image recording has been performed. In other words, the drive roller 49 and the spur roller 50 nippingly hold the leading edge side of the recording sheet, whereas the drive roller 47 and the pinch roller 48 nippingly hold the trailing edge side of the recording sheet.

When the recording sheet is further conveyed, the trailing edge of the recording sheet separates from the nip portion of the pair of conveying rollers 54, and is released from nipping by the drive roller 47 and the pinch roller 48. That is, the recording sheet is nippingly held only by the pair of discharging rollers 55, and is conveyed intermittently by predetermined linefeed width. After image recording is performed on a predetermined region of the recording sheet, the drive roller 49 is driven to rotate continuously. With this operation, the recording sheet nippingly held by the drive roller 49 and the spur roller 50 is discharged onto the sheet discharging tray 21. Note that, when the trailing edge of the recording sheet is released from nipping by the drive roller 47 and the pinch roller 48, the pinch roller holder 56 moves from the conveying position (first position) at the downstream side shown in FIG. 8B to the retracted position (second position) at the upstream side shown in FIG. 8A.

<Configuration of Support Mechanism of Pinch Roller 48>

Hereinafter, the support mechanism of the pinch roller 48 will be described in detail. The support mechanism of the pinch roller 48 includes a rotational shaft 65 rotatably supporting the pinch roller 48, the holder support member 57, a rolling bearing (or a movement support unit) 80, the pinch roller holder 56, the auxiliary holder 110, coil springs 61, and the pinch rollers 48.

<Holder Support Member 57>

Figure 5:
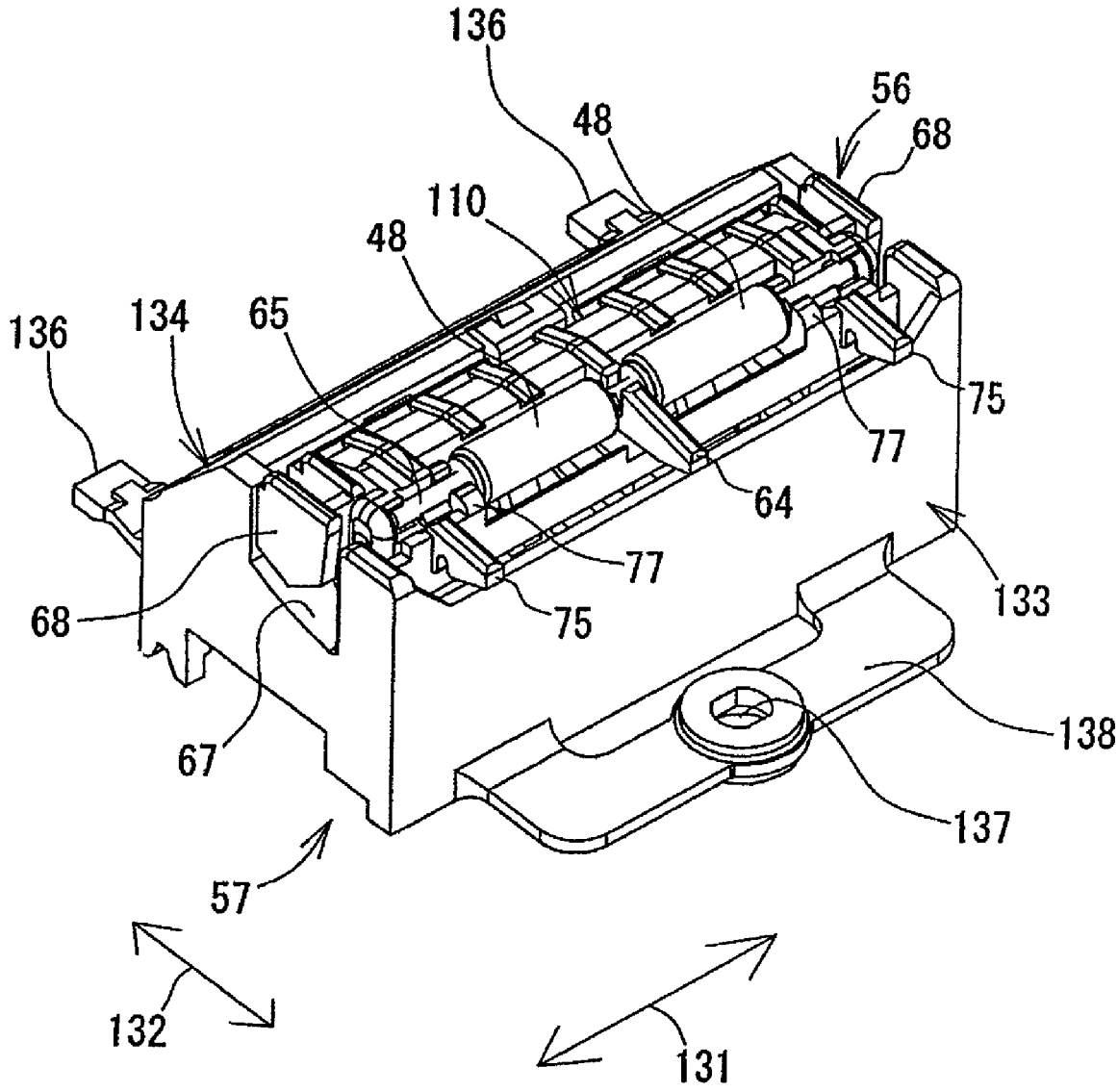
FIG. 5 is a perspective view showing a state where a pinch roller holder is supported by a holder support member.
Figure 6:
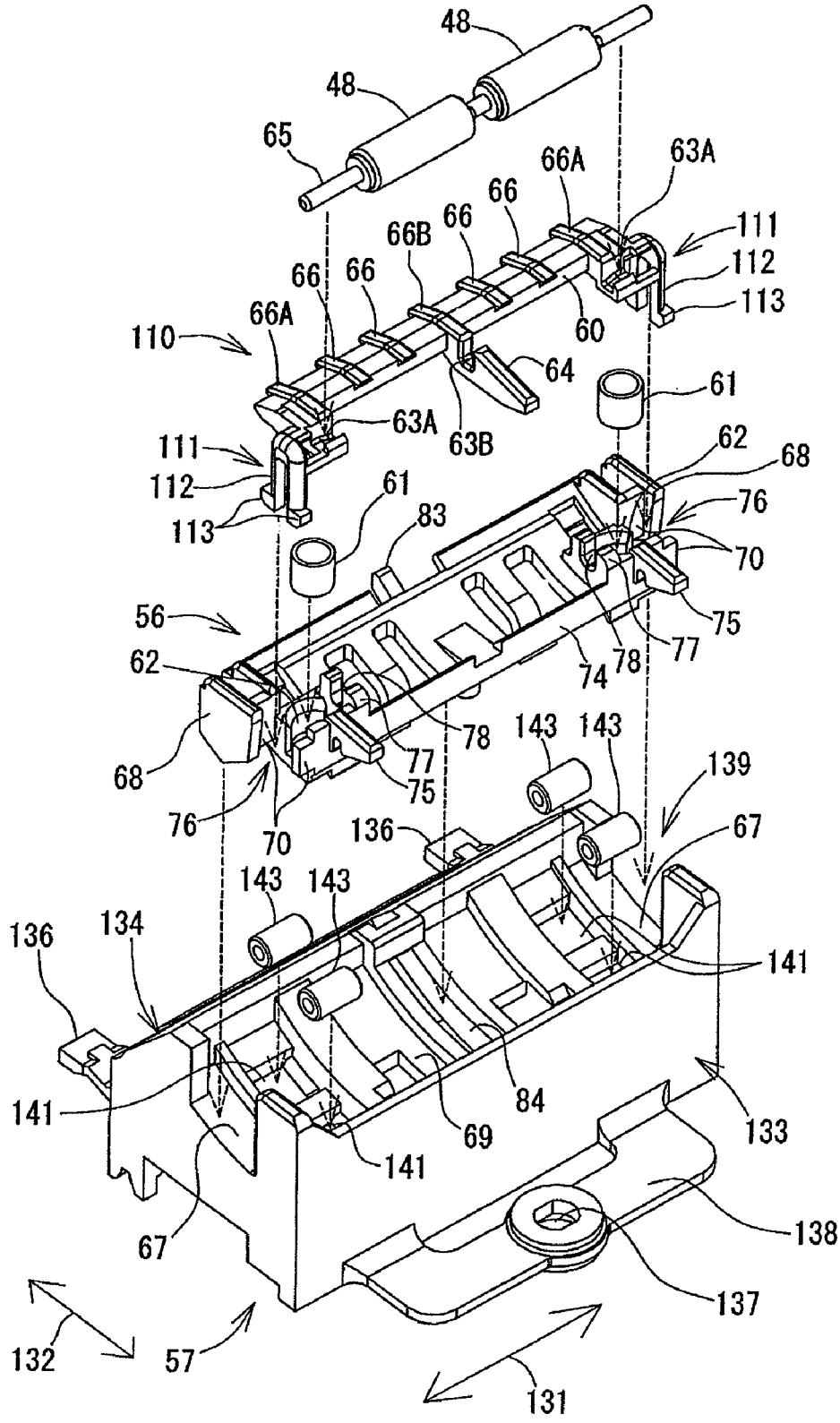
FIG. 6 is an exploded perspective view showing the holder support member and the pinch roller holder.

As shown in FIGS. 5 and 6, the holder support member 57 is formed in an elongated shape. The holder support member 57 is made by synthetic resin represented by polystyrene (PS) resin. The holder support member 57 functions as a base that supports the rolling bearing 80, the holder support member 57, the auxiliary holder 110, the coil springs 61, the rotational shaft 65, and the pinch rollers 48. The holder support member 57 is disposed within the printer section 2 in such an orientation that its longitudinal direction 131 corresponds to the axial direction of the drive roller 47, and that its shorter direction 132 corresponds to the conveying direction of recording sheets. More specifically, the holder support member 57 is disposed in such an orientation that a side surface 133 at one side in the shorter direction 132 faces the downstream side, and that a side surface 134 at the other side in the shorter direction 132 faces the upstream side. In the present embodiment, four holder support members 57 are aligned in the straight line in the axial direction of the drive roller 47. Each of the holder support members 57 supports members of the pinch roller holder 56, the auxiliary holder 110, the rotational shaft 65, the pinch roller 48, and the like. Hereinafter, for convenience, one of the holder support members 57 and each member supported by the holder support member 57 will be described.

The holder support member 57 is fixed to a frame constituting the printer section 2. More specifically, two pawls 136 having protruding shapes provided to the side surface 134 of the holder support member 57 are fitted in engaging grooves (not shown) of the frame, allowing the holder support member 57 to be positioned. An attachment seat 138 is provided to the lower end of the side surface 133, the attachment seat 138 extending toward the downstream side. A screw is driven into a through hole 137 formed in the attachment seat 138 in a state where the holder support member 57 is positioned with respect to the frame, allowing the attachment seat 138 to be fixed to the frame by the screw. Hence, the holder support member 57 is fixed to the frame.

A concave section 139 is formed on the upper side of the holder support member 57. The pinch roller holder 56 is supported on a bottom surface 69 of the concave section 139 via the rolling bearing 80, so that the pinch roller holder 56 can move on the bottom surface 69. Note that the actual shape of the bottom surface 69 of the concave section 139 is formed with concavities and convexities, because of the mechanism for supporting the rolling bearing 80 and the pinch roller holder 56. In this specification, however, "the bottom surface 69 of the concave section 139" is defined as the surface within the concave section 139 appearing on a plan view of the holder support member 57 as viewed above, unless otherwise stated.

Engaging recesses 67 are formed in the both ends of the bottom surface 69 of the concave section 139. The engaging recesses 67 engage protruding pieces 68 (to be described later) provided to the pinch roller holder 56. The length of the engaging recess 67 in the shorter direction 132 of the holder support member 57 is sufficiently longer than the length of the protruding piece 68 in the shorter direction 132. As will be described later, when the pinch roller holder 56 is supported by the holder support member 57 so that the pinch roller holder 56 can move in the shorter direction 132, the protruding pieces 68 engage the engaging recesses 67. At this time, the moving range of the pinch roller holder 56 is restricted to the range in which the protruding pieces 68 can move within the engaging recesses 67.

<Rolling Bearing (or Movement Support Unit) 80>

The rolling bearing 80 includes concave portions 141 and rollers 143. The concave portions 141 are formed in the bottom surface 69 of the concave section 139. The rollers 143 are accommodated in the concave portions 141. Four concave portions 141 are formed in the bottom surface 69 of the concave section 139. The rollers 143 are made in cylindrical shapes by resin or the like having good sliding characteristics, and are accommodated in the respective ones of the concave portions 141. More specifically, each roller 143 is accommodated in the concave portion 141, in such an orientation that the axis of the roller 143 corresponds to the longitudinal direction 131 of the holder support member 57. The depth of the concave portion 141 approximately equals to the radius of the roller 143. Accordingly, in a state where the roller 143 is accommodated in the concave portion 141, the roller surface of the roller 143 is exposed from the bottom surface 69. Further, the length of the concave portion 141 in the shorter direction 132 is at least longer than the diameter of the roller 143. Because the concave portion 141 has these sizes, when the pinch roller holder 56 is placed on the bottom surface 69 of the concave section 139 in a state where the roller 143 is accommodated in the concave portion 141, the pinch roller holder 56 can move along the bottom surface 69 of the concave section 139.

Note that the present embodiment uses the configuration where the concave portions 141 are formed in the bottom surface of the holder support member 57 and the rollers 143 are accommodated in the concave portions 141, as the rolling bearing 80 that supports the pinch roller holder 56 so that pinch roller holder 56 can move. However, another configuration may be used, for example, where concave portions similar to the concave portions 141 are formed in the bottom surface of the pinch roller holder 56, and the rollers 143 are accommodated between these concave portions and the bottom surface 69 of the holder support member 57. Still another configuration may be used where a well-known roller bearing or ball bearing is provided between the bottom surface 69 of the holder support member 57 and the bottom surface of the pinch roller holder 56, instead of the above-described rolling bearing 80. In summary, the mechanism for supporting the pinch roller holder 56 so that pinch roller holder 56 can move in the holder support member 57 is not limited to the above-described rolling bearing 80. A movement support mechanism with any configuration can be used as long as frictional force generated between the holder support member 57 and the pinch roller holder 56 is sufficiently small.

<Pinch Roller Holder 56>

As shown in FIGS. 5 and 6, the pinch roller holder 56 is formed in an elongated shape, like the holder support member 57. The pinch roller holder 56 is made; by synthetic resin such as polyacetal resin (POM). In the present embodiment, the auxiliary holder 110 to be described later, the coil springs 61, the pinch (follow) rollers 48, and the rotational shaft 65 are mounted to the pinch roller holder 56 to form one assembly. The assembly is supported within the concave section 139 of the holder support member 57.

The pinch roller holder 56 is accommodated in the concave section 139 of the holder support member 57. More specifically, the pinch roller holder 56 is disposed within the concave section 139, in such an orientation that the longitudinal direction 131 of the pinch roller holder 56 corresponds to the axial direction of the drive roller 47, and that the shorter direction 132 of the pinch roller holder 56 corresponds to the conveying direction of recording sheets.

The auxiliary holder 110 to be described later is supported at the upper side of the pinch roller holder 56 (that is, the side in confrontation with the drive roller 47) with the coil springs 61 interposed therebetween.

Cutouts 76 are formed in the both ends, respectively, of the pinch roller holder 56 in the longitudinal direction 131. Each of the cutouts 76 is formed substantially in a rectangular shape in a plan view. Support arms 111 of the auxiliary holder 110 to be described later are inserted in the cutouts 76. Hooking ribs 70 are provided at the both sides of each cutout 76 in the shorter direction 132, so that hooks 113 of the support arm 111 are hooked on (engaged with) the hooking ribs 70 when the support arm 111 is inserted.

Two spring accommodating chambers 62 are formed in the pinch roller holder 56. The spring accommodating chambers 62 are provided adjacent to and at the inner sides of the respective ones of the cutouts 76 in the longitudinal direction 131. The coil springs 61 are accommodated in the spring accommodating chambers 62. With this arrangement, the coil springs 61 are positioned in the pinch roller holder 56. Each of the coil springs 61 is used as a so-called compression spring, and has such spring length and spring force that can urge the rotational shaft 65 of the pinch rollers 48 toward the drive roller 47 side. Note that, instead of the coil springs 61, an elastic member such as a leaf spring and rubber may be used as urging means.

Positioning ribs 77 are provided at the inner sides of the respective ones of the spring accommodating chambers 62 in the longitudinal direction 131. A groove 78 is formed in the upper end of each positioning rib 77. Each of the positioning ribs 77 is erected from the upper surface of the pinch roller holder 56. The groove 78 is formed substantially in a U-shape in a side view, such that the groove 78 is cut deeply into the positioning rib 77 from its upper end in the vertical direction. The positioning ribs 77 are for positioning the pinch rollers 48 in the shorter direction 132. More specifically, the rotational shaft 65 is positioned in the shorter direction 132 by inserting the rotational shaft 65 in the grooves 78 of the positioning ribs 77 in a state where the auxiliary holder 110 to be described later is mounted on the pinch roller holder 56 and where the rotational shaft 65 of the pinch rollers 48 is supported by the auxiliary holder 110 (see FIG. 7). Positioning accuracy of the rotational shaft 65 by the positioning ribs 77 is determined by the size of the grooves 78 and the size of the rotational shaft 65.

A protruding piece 83 is provided at the center of the bottom surface of the pinch roller holder 56 in the longitudinal direction 131. The protruding piece 83 is inserted into and is engaged with an engaging groove 84 (see FIG. 6) formed in the bottom surface 69 of the concave section 139 of the holder support member 57. The protruding piece 83 is formed in a narrow-width shape that protrudes downward from the bottom surface of the pinch roller holder 56. The protruding piece 83 and the engaging groove 84 are formed in shapes that are elongated in the shorter direction 132. When the protruding piece 83 is inserted in the engaging groove 84, the pinch roller holder 56 is positioned in the holder support member 57 with respect to the longitudinal direction 131. In addition, the moving range of the pinch roller holder 56 is restricted to the shorter direction 132, that is, the conveying direction of recording sheets.

First guide ribs 75 are provided to a side surface 74 of the pinch roller holder 56 at the downstream side. The first guide ribs 75 protrude in the direction substantially perpendicular to the side surface 74. More specifically, as shown in FIG. 5, the first guide ribs 75 are provided to the side surface 74, such that the first guide ribs 75 protrude toward the platen 34 provided at the downstream side of the pinch roller holder 56. The first guide ribs 75 are formed integrally with the pinch roller holder 56. Further, the first guide ribs 75 are provided at a plurality of positions in the axial direction of the pinch rollers 48, that is, the longitudinal direction of the pinch roller holder 56. Specifically, one first guide rib 75 is provided for each of the both ends of the side surface 74 in the longitudinal direction 131.

The upper surfaces of the first guide ribs 75 serve as guide surfaces that direct the leading edge of a recording sheet toward the platen 34 side when the recording sheet is conveyed to the first guide ribs 75. The upper surfaces of the first guide ribs 75 are flat, and are approximately at the same level as the upper surface of the platen 34 when the pinch roller holder 56 is at the first position. Note that, when the pinch roller holder 56 is at a position other than the first position (any position from the first position to the second position), the first guide ribs 75 are sloped downward toward the upper surface of the platen 34.

<Auxiliary Holder 110>

The auxiliary holder 110 is mounted on the upper side of the pinch roller holder 56. Like the pinch roller holder 56 and the holder support member 57, the auxiliary holder 110 is formed in an elongated shape. The auxiliary holder 110 is made by synthetic resin such as polyacetal resin (POM). The auxiliary holder 110 is mounted on the pinch roller holder 56, in such an orientation that the longitudinal direction 131 of the auxiliary holder 110 corresponds to the axial direction of the drive roller 47.

The support arm 111 are provided to the respective ones of the both ends of the auxiliary holder 110 in the longitudinal direction 131. Each of the support arm 111 is a member that supports the auxiliary holder 110 so that the auxiliary holder 110 can move relative to the pinch roller holder 56 in the up-down direction, that is, the direction for moving the pinch rollers 48 toward and away from the drive roller 47. Each of the support arms 111 has two rods 112 extending downward from the lower surface of the auxiliary holder 110. A hook 113 is provided to the distal end of each rod 112, the hook 113 protruding outward in the shorter direction 132. When each of the support arms 111 is pushed into the cutout 76 of the pinch roller holder 56, the hooks 113 are pressed by the hooking ribs 70 so that the two rods 112 are bent in directions toward each other. Thus, the hooks 113 are allowed to be inserted through the cutouts 76. When the hooks 113 are inserted through the cutouts 76 and pass the lower ends of the hooking ribs 70, the rods 112 return to their original shapes, and the hooks 113 are engaged with the lower ends of the hooking ribs 70. In this way, the auxiliary holder 110 is mounted on the pinch roller holder 56.

In a state where the auxiliary holder 110 is mounted on the pinch roller holder 56, the rods 112 of the support arms 111 function as guides that restrict the moving direction of the auxiliary holder 110 to the up-down direction. The moving range of the auxiliary holder 110 is determined by the distance between the hooks 113 and the lower ends of the hooking ribs 70. That is, when the auxiliary holder 110 is urged downward in a state where the auxiliary holder 110 is mounted on the pinch roller holder 56, the hooks 113 are spaced away from the lower ends of the hooking ribs 70. In contrast, when the auxiliary holder 110 is lifted upward, the hooks 113 are engaged with the lower ends of the hooking ribs 70.

The auxiliary holder 110 is mounted on the pinch roller holder 56 from above the coil springs 61, in a state where the coil springs 61 are accommodated in the spring accommodating chambers 62. Accordingly, in a state where no external force is applied to the auxiliary holder 110, the auxiliary holder 110 is constantly lifted upward by the urging force of the coil springs 61. Conversely, if external force in the downward direction is applied to the auxiliary holder 110, the coil springs 61 are compressed to displace the auxiliary holder 110 in the direction toward the pinch roller holder 56. In the present embodiment, if the components (members) in an assembled state shown in FIG. 5 are build into the printer section 2, the pinch rollers 48 are pressed against the drive roller 47, and thus the auxiliary holder 110 are also pressed downward via the pinch rollers 48. Accordingly, in a state where the auxiliary holder 110 is built into the printer section 2, the auxiliary holder 110 is held such that the auxiliary holder 110 is movable in the up-down direction within the above-described moving range.

Seven second guide ribs 66 are integrally provided to the upper surface of the auxiliary holder 110. The second guide ribs 66 are provided for smoothly guiding the leading edge of a recording sheet conveyed from the upstream side to the nip portion of the pair of conveying rollers 54. Each of the second guide ribs 66 extends on the upper surface of the auxiliary holder 110 in the shorter direction 132, that is, the conveying direction. The second guide ribs 66 are arranged in parallel in the longitudinal direction 131, that is, the axial direction of the drive roller 47. Second guide ribs 66A arranged at the both end sides of the auxiliary holder 110 are formed in shapes longer than the other second guide ribs 66 in the shorter direction 132.

A third guide rib 64 is provided at the center of the auxiliary holder 110 in the longitudinal direction 131. The third guide rib 64 protrudes from a downstream-side end 60 in the same direction as the first guide ribs 75, that is, in the downstream direction. The third guide rib 64 is provided integrally with the auxiliary holder 110. Like the first guide ribs 75, the upper surface of the third guide rib 64 functions to direct the leading edge of a recording sheet toward the platen 34 side, when the recording sheet is conveyed to the upper surface of the third guide rib 64. Further, the third guide rib 64 also functions to support the trailing edge of a recording sheet that has separated from the nip portion of the pair of conveying rollers 54 at a position close to the nip portion, so that the trailing edge of the recording sheet does not contact the roller surface of the pinch rollers 48. The third guide rib 64 protrudes to the same position as the distal ends of the first guide ribs 75.

Bearings 63A are provided to the respective ones of the both ends of the auxiliary holder 110 in the longitudinal direction 131. In addition, a bearing 63B is provided to the third guide rib 64. The rotational shaft 65 of the pinch rollers 48 is supported by the bearings 63A and the bearing 63B. The bearings 63A protrude toward the downstream side from the end 60. The both ends of the rotational shaft 65 are supported by the bearings 63A. Each of the bearings 63A is formed in a groove shape, wherein the entrance part of each bearing 63A (groove) is slightly smaller than the diameter of the rotational shaft 65. Hence, when the rotational shaft 65 is pushed into the bearings 63A, the entrance part of each bearing 63A deforms and expands to allow the rotational shaft 65 to be inserted into the bearings 63A. Once the rotational shaft 65 is inserted in the bearings 63A, the deformed entrance part returns to its original shape, so that the rotational shaft 65 does not come off easily. On the other hand, the center part of the rotational shaft 65 is supported by the bearing 63B. The bearing 63B is provided to the third guide rib 64 at the end 60 side, and has a groove shape. The bearing 63B is for supplementarily supporting the rotational shaft 65 when a downward load is applied to the rotational shaft 65.

As described above, in the present embodiment, the second guide ribs 66 and the third guide rib 64 are integrally provided to the auxiliary holder 110. Hence, only the rotational shaft 65 of the pinch roller 48 stands between each guide rib 64, 66 and the pinch roller 48. Accordingly, the dimension tolerances affecting the height from the pinch roller 48 to each guide rib 64, 66 are only the cumulative value of the dimension tolerances of each of the pinch roller 48, the rotational shaft 65, and the auxiliary holder 110. Thus, the positional errors of the guide ribs 64 and 66 with respect to the pinch roller 48 can be reduced, compared with the conventional support mechanism affected by the dimension tolerances of a larger number of members. In other words, the distance between the pinch roller 48 and the guide ribs 64 and 66 can be maintained at a constant value with high precision. Hence, when a recording sheet enters the nip portion of the pair of conveying rollers 54, the recording sheet is smoothly guided to the nip portion by the second guide ribs 66. Further, when the trailing edge of the recording sheet separates from the nip portion, the trailing edge of the recording sheet is smoothly guided toward the downstream side by the third guide rib 64. Accordingly, conveyance malfunctions due to the positional errors of the guide ribs 64 and 66, such as paper jam and oblique conveyance of recording sheets, can be prevented.

<Pinch Rollers 48>

As shown in FIGS. 5 and 6, the pinch rollers 48 are formed in cylindrical shapes and made by resin or the like with good sliding characteristics. Each of the pinch rollers 48 is formed in a cylindrical shape formed with an inner hole extending in the axial direction. The rotational shaft 65 is inserted in the inner hole. With this arrangement, the pinch rollers 48 can rotate relative to the rotational shaft 65. Although the rotational shaft 65 can be made of various material such as synthetic resin and metal, it is preferable that the rotational shaft 65 be made of steel material such as stainless steel for enabling the pinch rollers 48 to rotate smoothly. Then, the rotational shaft 65 with a small diameter but having sufficient rigidity can be made. In the present embodiment, as shown in the drawings, two pinch rollers 48 are rotatably supported by the rotational shaft 65. Note that the number and the length of the pinch rollers 48 can be modified, as appropriate.

In this way, because the pinch rollers 48 are supported so that the pinch rollers 48 can rotate relative to the rotational shaft 65, it is not necessary that the rotational shaft 65 itself rotate within the grooves 78. Accordingly, the groove 78 may have such size that the rotational shaft 65 can be inserted without clearance. In the present embodiment, however, the groove 78 has such size that the groove 78 rotatably supports the rotational shaft 65 with substantially no resistance. Accordingly, even if the pinch rollers 48 and the rotational shaft 65 become fixed to each other so that the pinch rollers 48 cannot rotate relative to the rotational shaft 65, the pinch rollers 48 and the rotational shaft 65 can rotate relative to the auxiliary holder 110.

In the present embodiment, the pinch rollers 48, the rotational shaft 65, and the auxiliary holder 110 are described as separate members. However, it is not necessary that these members are separate members. For example, the rotational shaft 65 may be integrally provided to the auxiliary holder 110. In this case, when the rotational shaft 65 is inserted into the grooves 78, the auxiliary holder 110 as well as the rotational shaft 65 is positioned with respect to the conveying direction of recording sheets. With this arrangement, the dimension tolerances affecting the positions of the guide ribs 64 and 66 are only two members of the pinch rollers 48 and the auxiliary holder 110. Hence, the positional errors of the guide ribs 64 and 66 can be made smaller. Note that the rotational shaft 65 is not limited to the same material as the auxiliary holder 110. For example, if the rotational shaft 65 and the auxiliary holder 110 are formed integrally by insert molding, the rotational shaft 65 can be made of steel material, and the auxiliary holder 110 can be made of synthetic resin.

Further, the rotational shaft 65 may be integrally provided to the pinch rollers 48. In this case, when the rotational shaft 65 is inserted into the grooves 78, the pinch rollers 48 as well as the rotational shaft 65 are positioned with respect to the conveying direction of recording sheets. When the rotational shaft 65 and the pinch rollers 48 are formed integrally in this way, the dimension tolerances affecting the positions of the guide ribs 64 and 66 are only two members of the pinch rollers 48 and the auxiliary holder 110. Hence, the positional errors of the guide ribs 64 and 66 can be made smaller. Note that the rotational shaft 65 is not limited to the same material as the pinch rollers 48. For example, if the rotational shaft 65 and the pinch rollers 48 are formed integrally by insert molding, the rotational shaft 65 can be made of steel material, and the pinch rollers 48 can be made of synthetic resin.

Because the support mechanism of the pinch rollers 48 is constructed in this way, the pinch roller holder 56 is movably supported by the holder support member 57. The pinch rollers 48 are displaced with the rolling movement of the pinch roller holder 56. More specifically, the pinch roller holder 56 is movable between the retracted position (second position) shown in FIG. 8A and the conveying position (first position) shown in FIG. 8B.

Further, in the present embodiment, the third guide rib 64 is provided to the auxiliary holder 110, as described above. The pinch rollers 48 are supported by the auxiliary holder 110. Accordingly, when a recording sheet is nippingly held by the pinch rollers 48 and the drive roller 47, the auxiliary holder 110 and the third guide rib 64 as well as the pinch rollers 48 move away from the drive roller 47 by the amount equal to the thickness of the recording sheet. That is, the third guide rib 64 moves by the same displacing amount as the pinch rollers 48. Thus, the relative position of the pinch rollers 48 and the third guide rib 64 is always constant, regardless of whether a recording sheet is nippingly held by the pinch rollers 48 and the drive roller 47. In other words, the distance between the lower surface of the recording sheet and the upper end of the third guide rib 64 can be maintained at a constant distance during conveyance.

Figure 9A:
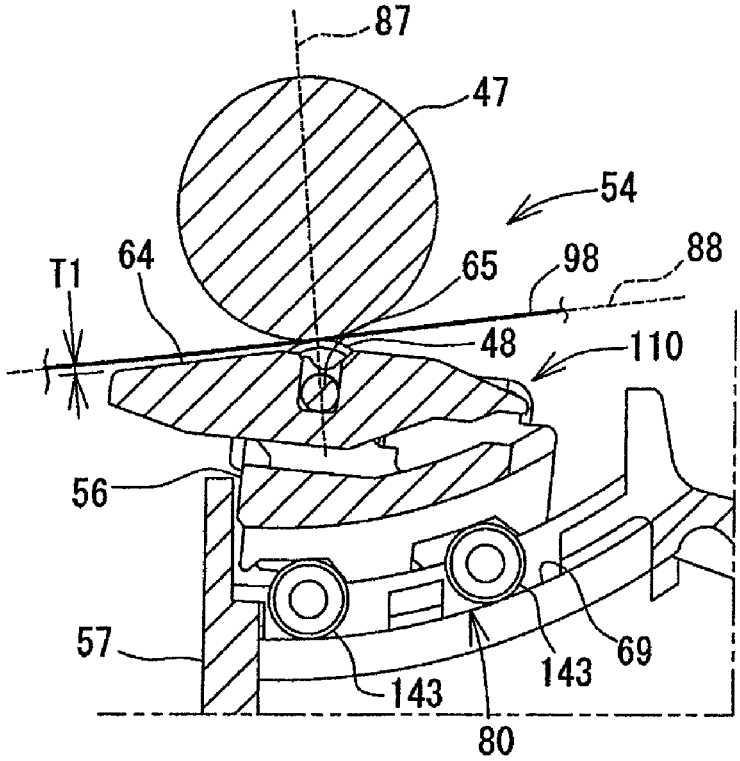
Figure 9B:
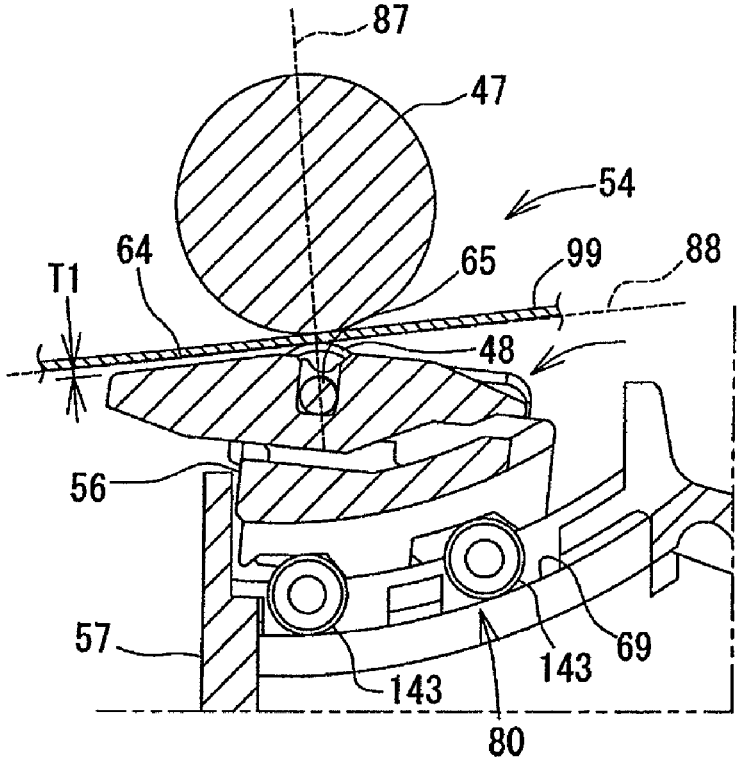

Accordingly, during conveyance of a recording sheet by the pair of conveying rollers 54, the third guide rib 64 as well as the pinch rollers 48 is pushed downward, in both cases when a thin recording sheet 98 such as copier paper is conveyed by the pair of conveying rollers 54 as shown in FIG. 9A and when a thick recording sheet 99 such as a postcard is conveyed as shown in FIG. 9B. Hence, a distance T1 between the lower surface of the recording sheet and the third guide rib 64 is always maintained at a constant value.

By using this support mechanism, the above-described distance T1 can be always set to a constant value at necessity minimum. Hence, even immediately after the trailing edge of a recording sheet separates from the nip portion between the pinch roller 48 and the drive roller 47, the trailing edge of the recording sheet can be supported near the nip portion by the third guide rib 64. That is, the recording sheet can be supported at a position where the trailing edge does not contact the roller surface of the pinch roller 48. This prevents the recording sheet from being pushed by the pinch roller 48 because the trailing edge of the recording sheet and the roller surface of the pinch roller 48 do not contact. Further, assume a case when a recording sheet of which trailing edge is bent downward or a recording sheet curved in an undulating state is conveyed, and the trailing edge of the recording sheet hangs down from the third guide rib 64 and contacts the roller surface of the pinch roller 48. Even in this case, the recording sheet and the roller surface contact each other near the nip portion, such that the recording sheet and the roller surface form an acute angle in a substantially horizontal state. Accordingly, the force in the direction for pushing the recording sheet is extremely small. Hence, the recording sheet is not pushed toward the downstream side.

Further, in the present embodiment, as shown in FIGS. 9A and 9B, the third guide rib 64 is provided such that the upper end of the third guide rib 64 is adjacent to a virtual plane 88 to be described later. The pair of conveying rollers 54 are for nippingly holding and conveying a recording sheet with the drive roller 47 and the pinch rollers 48. Hence, the conveying path in the vicinity of the pair of conveying rollers 54 approximately corresponds to the virtual plane 88, wherein the virtual plane 88 passes through the intersection line of: a plane 87 including both the axis of the drive roller 47 and the rotational shaft 65 of the pinch roller 48; and the roller surface of the pinch roller 48 (the roller surface facing the drive roller 47 side in FIGS. 9A and 9B), and wherein the virtual plane 88 is perpendicular to the plane 87. If the upper end of the third guide rib 64 is adjacent to the virtual plane 88, the third guide rib 64 can support the trailing edge of the recording sheet immediately after the trailing edge separates from the nip portion between the drive roller 47 and the pinch roller 48, so that the trailing edge does not contact the roller surface of the pinch roller 48.

Further, in the configuration for movably supporting the pinch roller holder 56, when the pinch roller holder 56 moves to the retracted position, a gap T2 (see FIG. 8A) with predetermined width is formed between the upstream-side end 95 of the ribs 94 of the platen 34 and the pinch roller holder 56. However, the gap T2 is closed by the above-described first guide ribs 75 and the third guide-rib 64. Hence, even if a recording sheet conveyed by the pair of conveying rollers 54 moves toward the gap T2, the first guide ribs 75 and the third guide rib 64 prevent the recording sheet from entering the gap T2. At the same time, the leading edge of the recording sheet is directed to the platen 34 side by the first guide ribs 75 and the third guide rib 64. More specifically, the leading edge of the recording sheet is directed to the sloped surface 96 formed at the upstream-side end 95 of the ribs 94. Accordingly, the recording sheet is smoothly guided toward the upper surface of the ribs 94 along the sloped surface 96. Hence, recording sheets can be conveyed to the platen 34 stably, and also paper jam can be prevented.

Figure 8A:
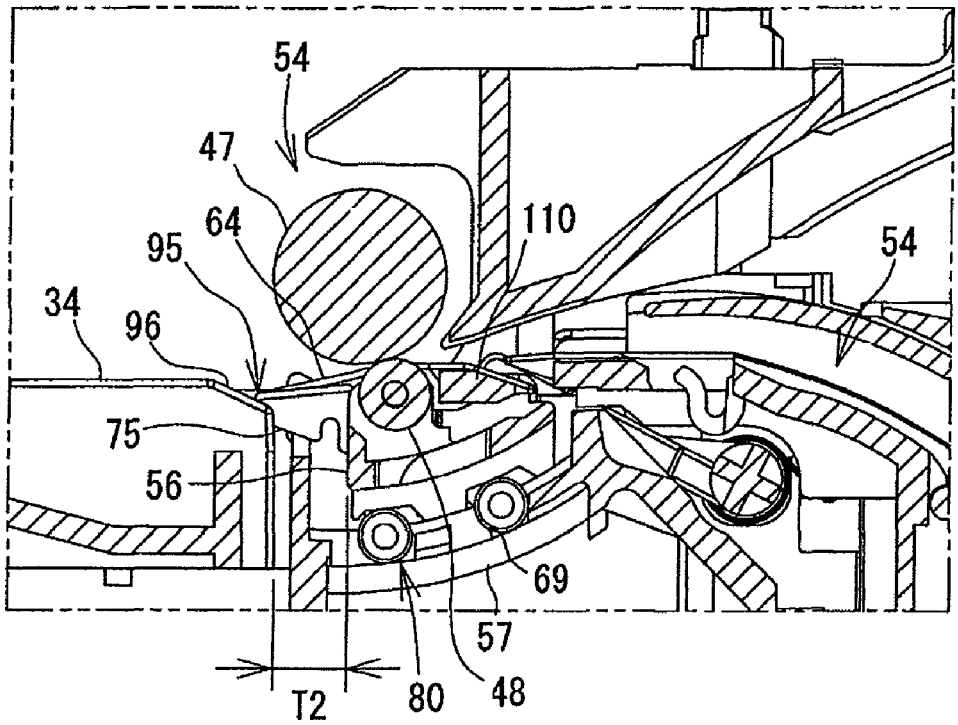
Figure 8B:
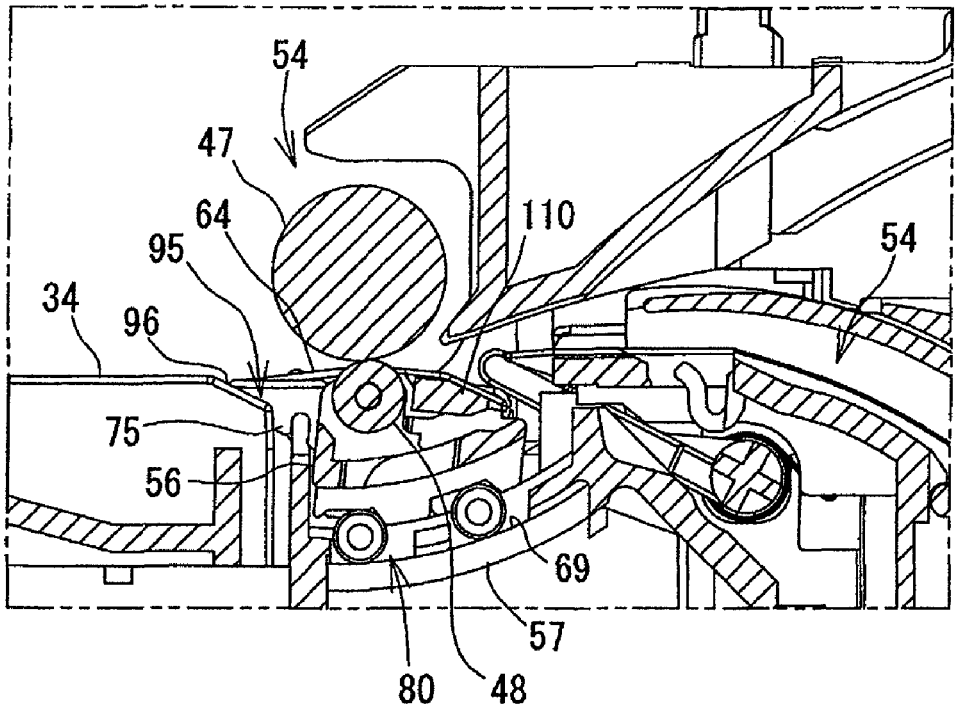

In the present embodiment, as shown in FIGS. 8A and 8B, the first guide ribs 75 and the third guide rib 64 are provided at positions corresponding to gaps formed between adjacent ribs 94, so that the first guide ribs 75 and the third guide rib 64 do not interfere with the plurality of ribs 94 extending to the upstream-side end 95 of the platen 34. In the present embodiment, the amounts of protrusion (the lengths of protrusion) of the first guide ribs 75 and the third guide rib 64 are set so that the first guide ribs 75 and the third guide rib 64 enter the gaps between the ribs 94, regardless of the position of the pinch roller holder 56 that is supported movably in the conveying direction. In other words, the first guide ribs 75 and the third guide rib 64 are arranged so that the upstream-side end 95 of the platen 34 intersect with the first guide ribs 75 and the third guide rib 64 in a plan view, even when the pinch roller holder 56 is held at the farthest position from the platen 34, that is, the retracted position (second position) shown in FIG. 8A. Accordingly, the first guide ribs 75 and the third guide rib 64 are always inserted in the gaps between the ribs 94 (see FIGS. 8A and 8B) in a state where the pinch roller holder 56 is supported by the holder support member 57, regardless of the position of the pinch roller holder 56. Further, when the pinch roller holder 56 moves on the holder support member 57, with the rolling movement, the first guide ribs 75 and the third guide rib 64 move reciprocatingly in the conveying direction. With this reciprocating movement, the first guide ribs 75 and the third guide rib 64 are inserted into and retracted from the gaps formed between the ribs 94.

As shown in FIGS. 8A and 8B, the first guide ribs 75 are arranged such that the upper surface (guide surface) of the first guide ribs 75 is located at a lower position than the upper surface of the platen 34. With this arrangement, even when a recording sheet is conveyed toward the first guide ribs 75, the leading edge of the recording sheet is smoothly guided to the platen 34 side. Then, the recording sheet directed to the platen 34 side is smoothly guided to the support base, in such a manner the recording sheet moves up the sloped surface 96 formed at the upstream-side end 95 (rear end) of the platen 34.

In the present embodiment, the first guide ribs 75 are arranged such that the upper surface of the first guide ribs 75 is located at a lower position than the upper surface of the platen 34, and that the upper surface of the first guide ribs 75 is located at a higher position than the lower end of the sloped surface 96 of the upstream-side end 95 (rear end) of the platen 34. Accordingly, recording sheets can be guided to the platen 34 more smoothly.

<Moving Range of Pinch Roller Holder 56>

The moving range of the pinch roller holder 56 on the holder support member 57 will be described below.

Figure 10:
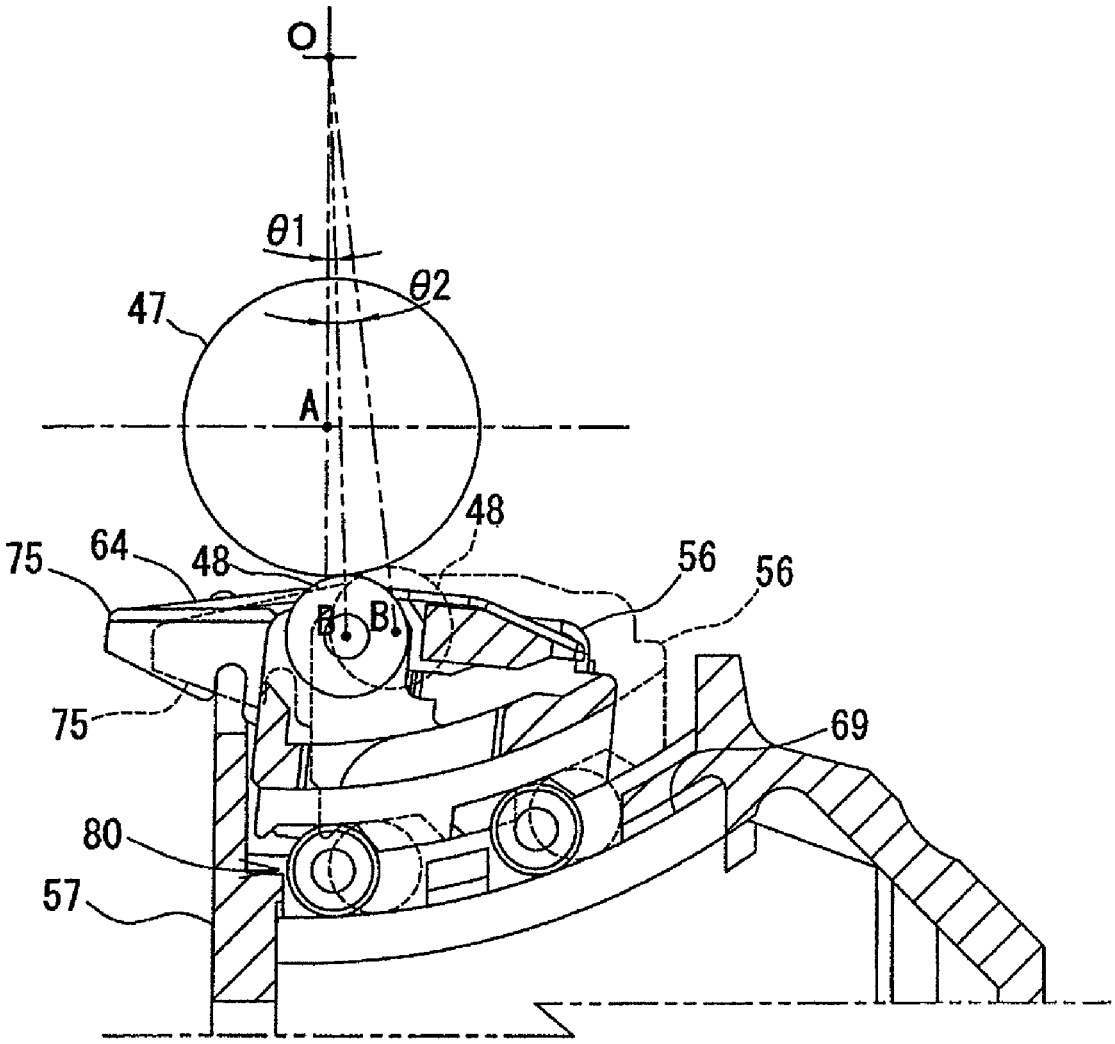
FIG. 10 is a partial enlarged view for illustrating the moving range of the pinch roller holder.

In the present embodiment, as shown in FIG. 10, the bottom surface 69 (including the bottom surfaces of the concave portions 141) of the concave section 139 of the holder support member 57 is formed in a curved shape in a state where the holder support member 57 is attached to the frame. The pinch roller holder 56 is supported at its bottom surface, in a state where the rolling bearing 80 is interposed between the bottom surface 69 and the bottom surface of the pinch roller holder 56.

As shown in FIG. 10, the bottom surface 69 of the concave section 139 is sloped downward from the upstream side toward the downstream side. The bottom surface 69 has a shape corresponding approximately to an arc of a cylindrical shape, the arc being drawn around a revolution center O that is included in the vertical plane passing through a central axis A of the drive roller 47 and that is in parallel with the central axis A. Accordingly, the pinch roller holder 56 moves along the bottom surface 69 by the rolling bearing 80. In other words, the pinch roller holder 56 moves around the revolution center O as the center of revolution. At this time, because the auxiliary holder 110 is urged by the coil springs 61, with the rolling movement of the pinch roller holder 56, the pinch rollers 48 move along the outer circumferential surface of the drive roller 47 while constantly maintaining the state being pressed against the drive roller 47. Note that it is not necessary that the revolution center O be included in the vertical plane passing through the central axis A. It is sufficient that the revolution center O is located at the second position side of a plane including both the central axis A and a central axis B of the pinch rollers 48 when the pinch roller holder 56 is located at the first position, so that the compression amount of the coil springs 61 becomes smaller as the pinch roller holder 56 moves to the upstream side.

In the present embodiment, as shown in FIG. 10, the moving range of the pinch roller holder 56 in the shorter direction 132 is restricted to the range between: the conveying position where an angle formed between the vertical plane passing through the revolution center O and a plane passing through the revolution center O and the central axis B of the pinch rollers 48 is 61 in the direction toward the rear side of the drive roller 47; and the retracted position where the angle formed between the vertical plane passing through the revolution center O and the plane passing through the revolution center O and the central axis B of the pinch rollers 48 is θ2 (greater than θ1) in the direction toward the rear side of the drive roller 47. Note that the protruding pieces 68 and the downstream-side inner wall of the engaging recesses 67 for restricting the moving range in the forward direction in the shorter direction 132 serve as the first restricting member of the invention. In addition, the protruding pieces 68 and the upstream-side inner wall of the engaging recesses 67 for restricting the moving range in the rearward direction in the shorter direction 132 serve as the second restricting member of the invention.

The pinch roller holder 56 and the holder support member 57 are configured as described above. Thus, when a recording sheet is nippingly held by the pair of conveying rollers 54 (during conveyance of a recording medium), the pinch roller holder 56 moves to the conveying position (see FIG. 8B). In contrast, when the trailing edge of the recording sheet separates from the pair of, conveying rollers 54 (not during conveyance of a recording medium), the pinch roller holder 56 moves to the retracted position (see FIG. 8A).

<Rationale for Rolling Movement of Pinch Roller Holder 56>

Figure 11:
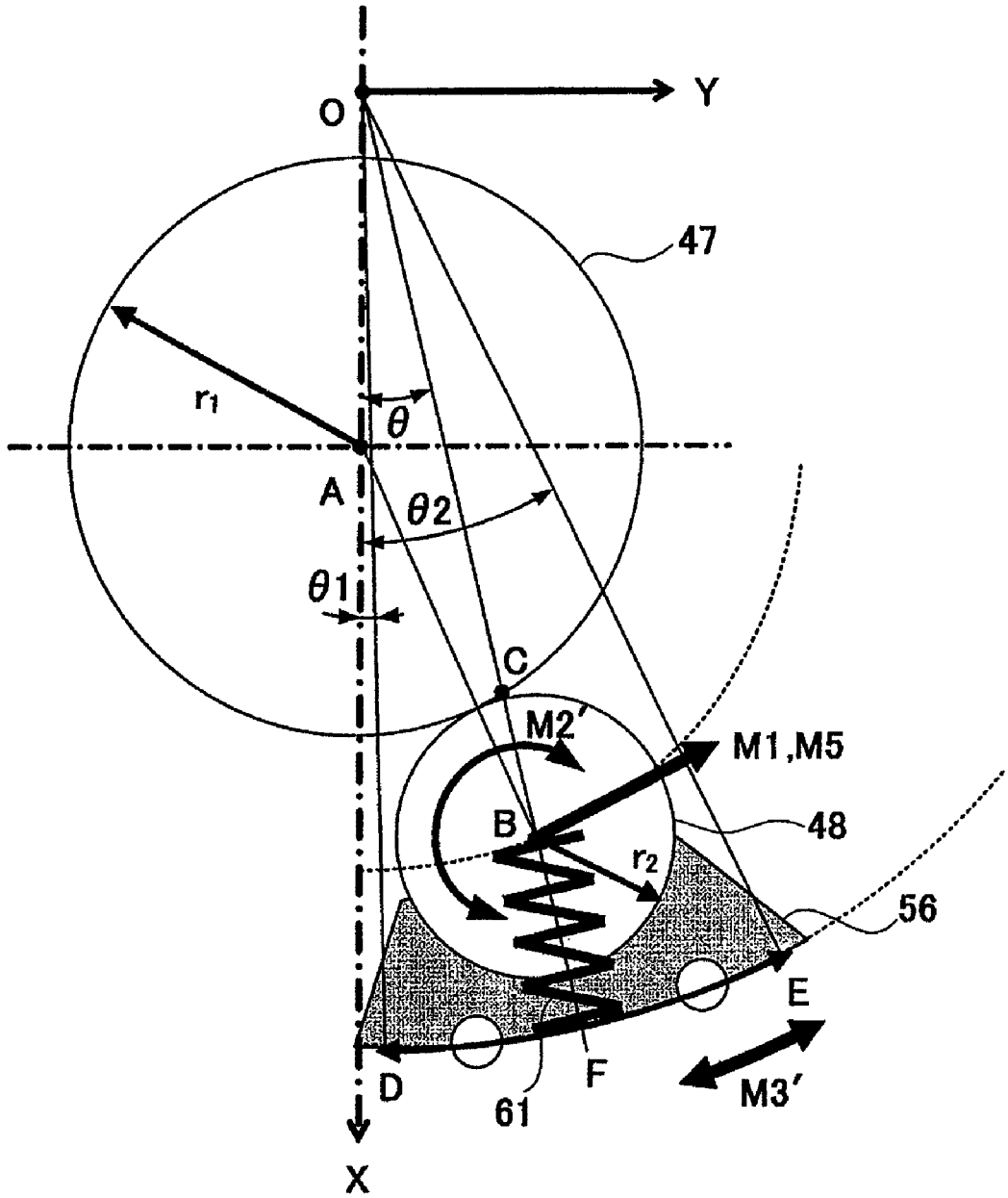
FIG. 11 is a schematic view showing the cross-section of a drive roller and a pinch roller in an XY coordinate having a center O as the origin.
Figure 12:
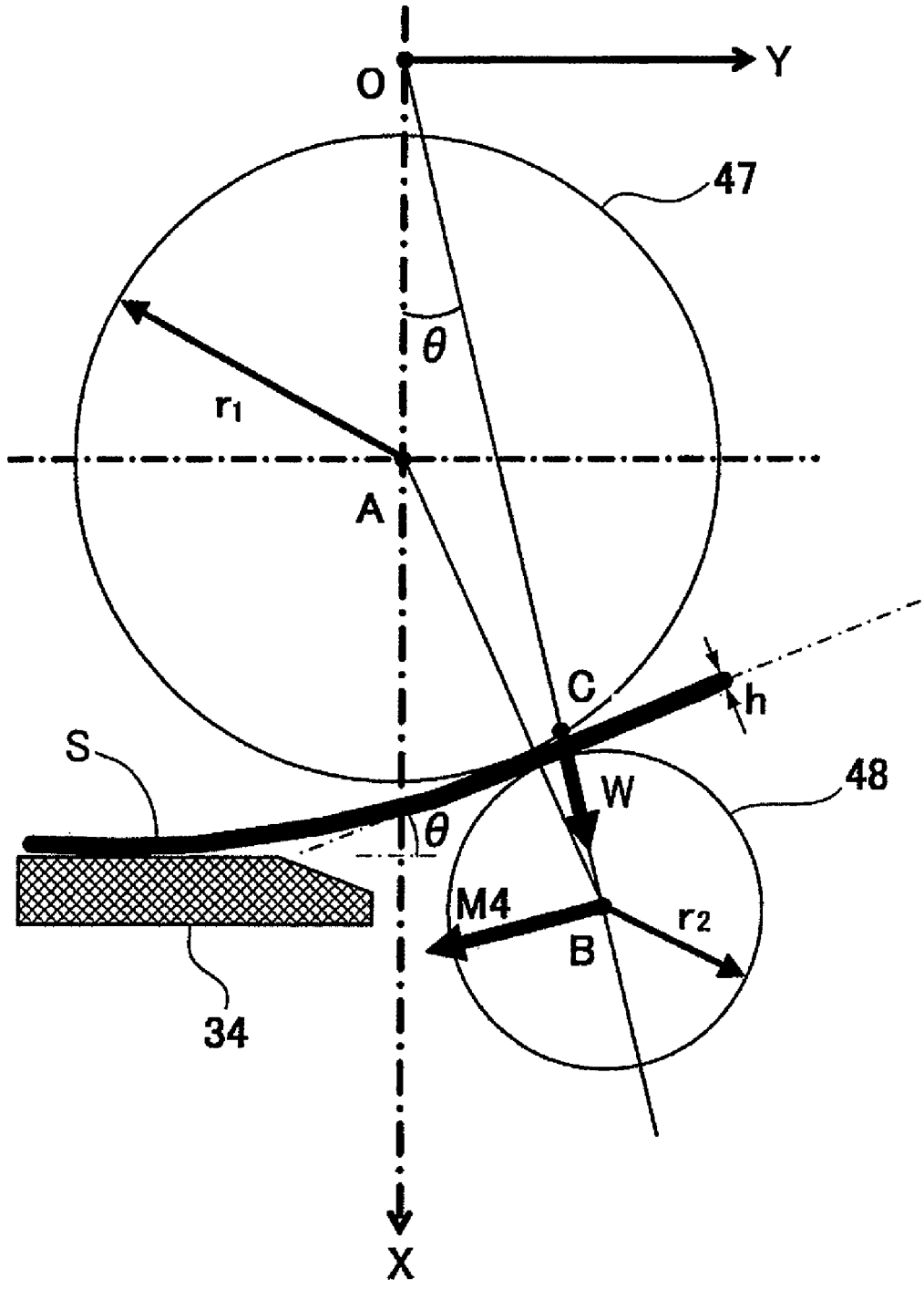
FIG. 12 is a schematic view showing a state where the drive roller and the pinch roller pinchingly hold a recording medium in the XY coordinate of FIG. 11.

Next, the rationale for rolling movement of pinch roller holder 56 will be described while referring to FIGS. 11 and 12. Here, FIG. 11 is a schematic view showing the cross-section of the drive roller 47 and the pinch roller 48 in the XY coordinate having a center O as the origin. FIG. 12 is a schematic view showing a state where the drive roller 47 and the pinch roller 48 pinchingly hold a recording sheet (indicated by sign S) in the XY coordinate of FIG. 11. Here, A is the rotational center of the drive roller 47, r1 is the radius of the drive roller 47, B is the rotational center of the pinch roller 48, and r2 is the radius of the pinch roller 48. The rotational center A is located on the X-axis. The origin O is located at a position separated away from the rotational center A by more than or equal to the radius r1 of the drive roller 47 in the negative direction of the X-axis. Further, the origin O is coincident with the center of the curved shape of the bottom surface 69 of the concave section 139, that is, the origin O is coincident with the above-described revolution center O. The pinch roller holder 56 is movable between: a position D that is moved from the X-axis by θ1 in the counterclockwise direction about the origin O as the center; and a position E that is similarly moved from the X-axis by θ2 (greater than θ1). Here, the position D corresponds to the above-described conveying position (see FIG. 8B), and the position E corresponds to the above-described retracted position (see FIG. 8A). Note that, for convenience of description, the centers O, A, and B are defined as shown in FIGS. 11 and 12. However, needless to say, the positions of the respective centers of the drive roller 47, the pinch roller 48, and the bottom surface 69 are not limited to the above-described positions.

Here, an angle θ is defined as the angle formed between a line segment OA and a line segment OB, when the pinch roller 48 is moved to an arbitrary position. That is, the possible range of the angle θ is $\theta 1 \leqq \theta \leqq \theta 2$. The pinch roller 48 is urged toward the drive roller 47 (in the direction of a line segment AB) by the coil spring 61 accommodated in the pinch roller holder 56 in a compressed state.

As shown in the drawing, if $\theta > 0$, the center O of an arc DE does not match the rotational (moving) center A of the drive roller 47. Hence, as θ increases, the pinch roller holder 56 separates relatively away from the drive roller 47. Thus, as θ increases, the coil spring 61 expands. That is, as θ increases, elastic energy E of the coil spring 61 decreases. At this time, a moment M1 acts on the pinch roller 48, the moment M1 being in the counterclockwise direction and about the center A, that is, in the direction perpendicular to the line segment AB, the moment M1 having magnitude in proportion to the decreased amount dE/dθ of the elastic energy E.

On the other hand, the following rotation of the pinch roller 48 causes frictional force (frictional moment) M2' to act on the pinch roller 48, frictional force M2' being about the center B and being in the opposite direction to the rotational direction of the pinch roller 48. A moment M2 is defined as the moment obtained by converting the frictional force M2' into a force about the center A, that is, a force in the direction perpendicular to the segment AB. The frictional force M2' generated at this time is static frictional force that is generated in the sliding surface between the pinch roller 48 and the rotational shaft 65 due to rotation of the pinch roller 48. Note that the moment M2 is not shown in FIG. 11.

Further, when the pinch roller holder 56 moves on the bottom surface 69 of the concave section 139 of the holder support member 57, rolling frictional force (frictional moment) M3' is generated. The rolling frictional force M3' acts around the center O, that is, in the direction perpendicular to a line segment OB. A moment M3 is defined as the moment obtained by converting the rolling frictional force M3' into a force about the center A, that is, a force in the direction perpendicular to the segment AB. Here, the above-described rolling frictional force is referred to as the moment M3. Note that the moment M3 is not shown in FIG. 11.

Additionally, when a recording sheet is conveyed by the drive roller 47 and the pinch rollers 48, as shown in FIG. 12, force W including the weight of the recording sheet, elastic force due to bending of the recording sheet, and the like acts in the direction toward the center of the pinch roller 48. The force W causes a moment M4 to be generated in the direction of reducing the angle θ. Especially, in the present embodiment, as shown in the drawing, the recording sheet is conveyed such that the recording sheet is pressed against the platen 34 from the upper side by the angle θ, which generates the moment M4 to a non-negligible extent. Note that EI is defined as the rigidity of the recording sheet.

Further, when the leading edge of a recording sheet enters the nip portion between the drive roller 47 and the pinch roller 48, or when the trailing edge of a recording sheet separates from the nip portion, the length of the coil spring 61 changes by the amount equal to thickness h of the recording sheet. More specifically, the coil spring 61 is compressed by the thickness h in the former case, whereas the coil spring 61 expands by the thickness h in the latter case. Accordingly, in this case as well, the elastic energy of the coil spring 61 increases and decreases, a moment M5 about the center A and having magnitude in proportion to dE/dθ is generated, like the above-described moment M1.

Here, the angle θ ($\theta 1 \leqq \theta \leqq \theta 2$), the thickness h of the recording sheet, and the rigidity EI of the recording sheet are variables. Hence, the moment M1 is represented by a function of the angle θ and the thickness h. The moment M4 is represented by a function of the angle θ and the rigidity EI. The moment M5 is represented by a function of the thickness h. Although, in a precise sense, the moments M2 and M3 are functions of the angle θ and the thickness h, the moments M2 and M3 are extremely small compared with the moments M1, M4, and M5. Thus, the moments M2 and M3 are considered as constant values here. Hereinafter, functions of the angle θ are represented by M1(θ) and M4(θ).

Assume that no slippage is generated between the drive roller 47 and the pinch roller 48. Also assume that the frictional force between the drive roller 47 and the pinch roller 48 is sufficiently large, and that the frictional force between the pinch roller 48 and the recording sheet is sufficiently large. Then, in the present embodiment, the above-described moments M1 through M5 satisfy the expressions indicated below.

That is, when a recording sheet is not conveyed by the drive roller 47 and the pinch roller 48, the following expression (1) is satisfied. At this time, the moment M2 acts around the center A in the clockwise direction, and the moment M3 acts around the center A in the counterclockwise direction.

$$M1(\theta)+M3>M2 \quad (1)$$

Accordingly, in this case, the pinch roller holder 56 moves toward the upstream side in the conveying direction of recording sheets, and is retracted rearward. Then, the attitude of the pinch roller holder 56 is held at the position of θ=θ2 (retracted position).

When the recording sheet reaches the nip portion between the drive roller 47 and the pinch roller 48, the leading edge of the recording sheet is nippingly held by rotation of the drive roller 47, and the following expression (2) is satisfied. At this time, the moment M3 acts around the center A in the counterclockwise direction, and the moment M5 acts around the center A in the clockwise direction.

$$M1(\theta)+M3<M4(\theta)+M5 \quad (2)$$

At this time, the pinch roller holder 56 moves toward the downstream side in the conveying direction, and the attitude of the pinch roller holder 56 is held at the position of θ=θ1 (conveying position).

During conveyance of the recording sheet, the following expression (3) is satisfied. At this time, the moment M2 acts around the center A in the clockwise direction, and the moment M3 acts around the center A in the clockwise direction.

$$M1(\theta)<M2+M3+M4(\theta) \quad (3)$$

Thus, the attitude of the pinch roller holder 56 is continually held at the position of θ=θ1 (conveying position).

When the trailing edge of the recording sheet separates from the nip portion between the drive roller 47 and the pinch roller 48, the following expression (4) is satisfied. At this time, the moment M3 acts around the center A in the clockwise direction, and the moment M5 acts around the center A in the counterclockwise direction, like the moment M1.

$$M1(\theta)+M5>M3 \quad (4)$$

As can be understood from the above expression (4), the moment M1(θ)+M5 (left side) is generated when the trailing edge of the recording sheet separates from the nip portion between the drive roller 47 and the pinch roller 48, whereas only the moment M3 (right side) acts as the frictional force. Here, the moment M1(θ)+M5 for moving the pinch roller holder 56 toward the upstream side of the recording sheet is greater than the moment M3 for preventing the rolling movement. Accordingly, the pinch roller holder 56 is moved toward the upstream side of the recording sheet. Here, the moment M3 is small frictional force generated by the rolling bearing 80. That is, the moment M3 is extremely small compared with the moment M1(θ)+M5. Accordingly, in this case, almost all of the moment M1(θ)+M5 acts to move the pinch roller holder 56 toward the upstream side of the recording sheet. Thus, the pinch roller holder 56 is moved quickly. Note that, once the pinch roller holder 56 is retracted, the attitude of the pinch roller holder 56 is held at the position of θ=θ2 (retracted position).

If there arises an abnormality that the pinch roller holder 56 does not return to the position of θ=θ2 (retracted position) after the trailing edge of the recording sheet separates from the nip portion between the drive roller 47 and the pinch roller 48, the drive roller 47 is controlled to rotate in the reverse direction so that the following expression (5) is satisfied. Hence, the pinch roller holder 56 can be moved to the position of θ=θ2 (retracted position).

$$M1(\theta)+M2>M3 \quad (5)$$

In this case, the moment M2 acts around the center A in the counterclockwise direction, and the moment M3 acts around the center A in the clockwise direction.

As described above, in the multifunction apparatus 1 in which the pinch roller holder 56 is movably supported via the rolling bearing 80, the pinch rollers 48, the pinch roller holder 56, the holder support member 57, the coil springs 61, and the like are arranged such that expressions (1) through (5) are satisfied. With this arrangement, when a recording sheet is nippingly held by the pair of conveying rollers 54, the pinch roller holder 56 is moved quickly toward the downstream side in the conveying direction. Further, when the above-mentioned nipping of the recording sheet is released, the pinch roller holder 56 is moved quickly toward the downstream side in the conveying direction. Accordingly, compared with the conventional structure using sliding friction, the amount of pushing the recording sheet in the conveying direction can be made almost zero. This prevents the quality of an image recorded on the recording sheet from being deteriorated.

While the invention has been described in detail with reference to the above embodiments thereof, it would be apparent to those skilled in the art that various changes and modifications may be made therein without departing from the scope of the claims.

COMPARATIVE EXAMPLES

Hereinafter, comparative examples will be described. The comparative examples are presented for describing advantages of the sheet conveying device and the image recording apparatus according to the above-described embodiment.

Figure 13A:
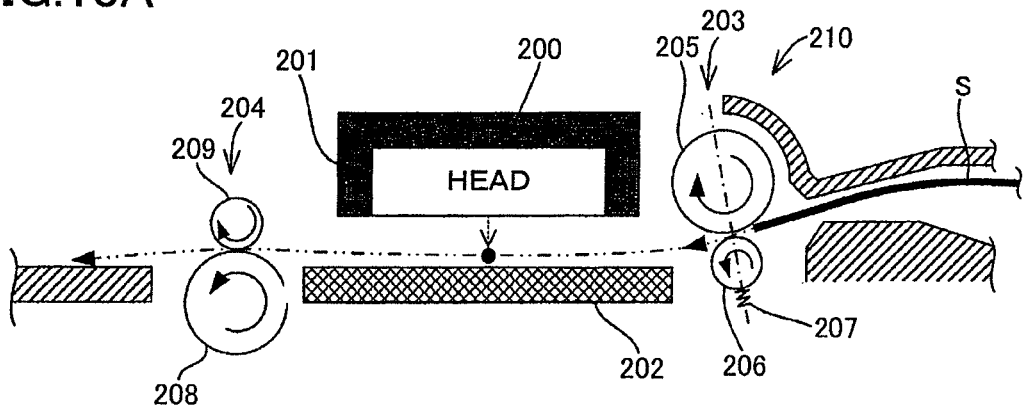
FIGS. 13A through 13C are schematic views showing the configuration of a sheet conveying device according to a comparative example.
Figure 13B:
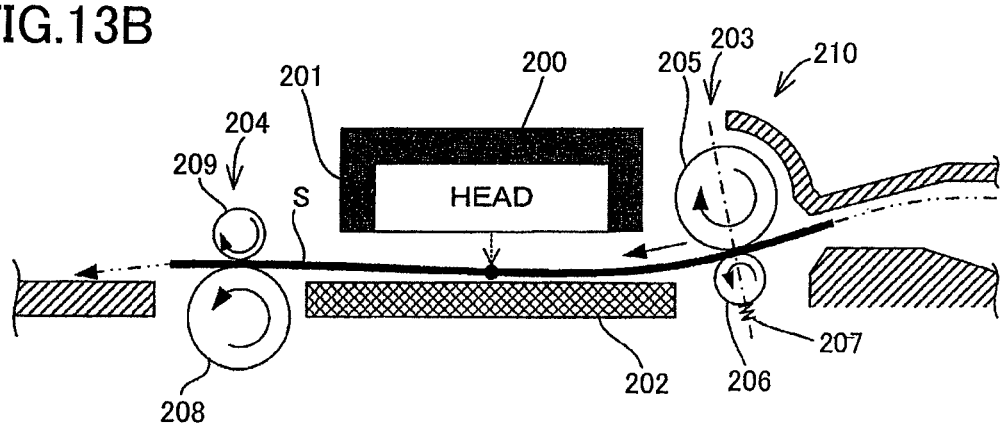
Figure 13C:
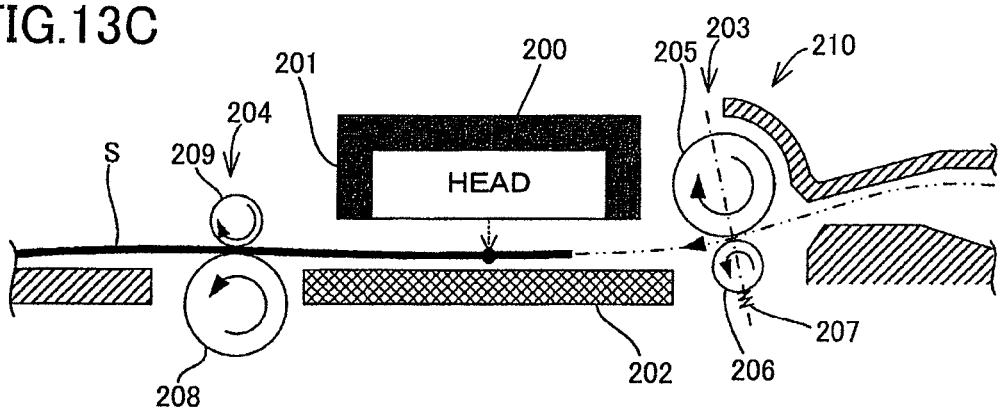

A first comparative example will be described while referring to FIGS. 13A through 14B. As shown in FIGS. 13A through 13C, an inkjet-type image recording apparatus according to the first comparative example is provided with a sheet conveying device 210 that conveys a recording sheet S toward a platen 202. The sheet conveying device 210 includes a pair of conveying rollers 203 arranged at the upstream side of the platen 202 in the conveying direction (hereinafter abbreviated as "upstream side") and a pair of discharging rollers 204 arranged at the downstream side of the platen 202 in the conveying direction (hereinafter abbreviated as "downstream side").

When an image is recorded in the image recording apparatus, the pair of conveying rollers 203 is driven intermittently for conveying the recording sheet S intermittently by a predetermined length. During the stopped time of the intermittent conveyance, a recording head 200 is slidingly moved in the direction (the direction perpendicular to the drawing sheet of FIGS. 13A through 13C) perpendicular to the conveying direction (the left-right direction in FIGS. 13A through 13C) of the recording sheet S, while ink is ejected from the nozzles of the recording head 200 so that ink adheres to the recording sheet S. This operation is repeated for each intermittent conveyance, thereby continuously recording images with a predetermined length on the recording sheet S. Note that a controller (not shown) controls the rotations of the pair of conveying rollers 203 and the pair of discharging rollers 204, thereby performing the above-described intermittent conveyance.

As shown in FIGS. 13A through 13C, the pair of conveying rollers 203 includes a drive roller 205 and a follow roller 206. The drive roller 205 receives rotational force transmitted from a motor or the like, and is driven to rotate. The follow roller 206 is urged by a coil spring 207 or the like so as to be pressed against the drive roller 205, and followingly rotates. As shown in FIG. 13A, when the leading edge of the recording sheet S supplied from a sheet supplying cassette (not shown) reaches the pair of conveying rollers 203, the leading edge of the recording sheet S is nipped by the drive roller 205 and the follow roller 206, and the pair of conveying rollers 203 starts conveying of the recording sheet S. At this time, the coil spring 207 is compressed by an amount of thickness of the recording sheet S, and the follow roller 206 separates from the drive roller 205. As the recording sheet S is conveyed, the leading edge of the recording sheet S is nipped by the pair of discharging rollers 204 and, as shown in FIG. 13B, the recording sheet S is conveyed by both the pair of conveying rollers 203 and the pair of discharging rollers 204. As the recording sheet S is further conveyed, as shown in FIG. 13C, the trailing edge of the recording sheet S separates from the pair of conveying rollers 203 and the recording sheet S is conveyed only by the pair of discharging rollers 204. At this time, the coil spring 207 expands by the amount of thickness of the recording sheet S, and the follow roller 206 is pressed against the drive roller 205. Note that the pair of discharging rollers 204 also includes a drive roller 208 and a follow roller 209, like the pair of conveying rollers 203. Here, because the pair of discharging rollers 204 is for nipping the recording sheet S on which an image has been recorded, the pressing force is set to a small value in order to prevent degradation of the image.

Figure 14A:
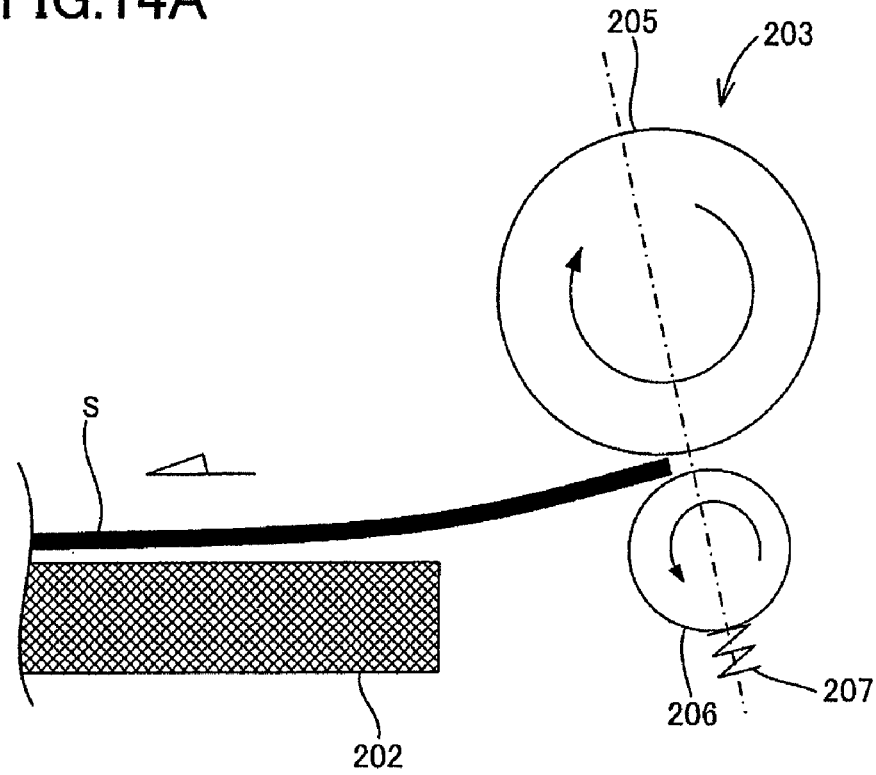
FIGS. 14A and 14B are enlarged views showing a pair of conveying rollers in the sheet conveying device according to the comparative example.
Figure 14B:
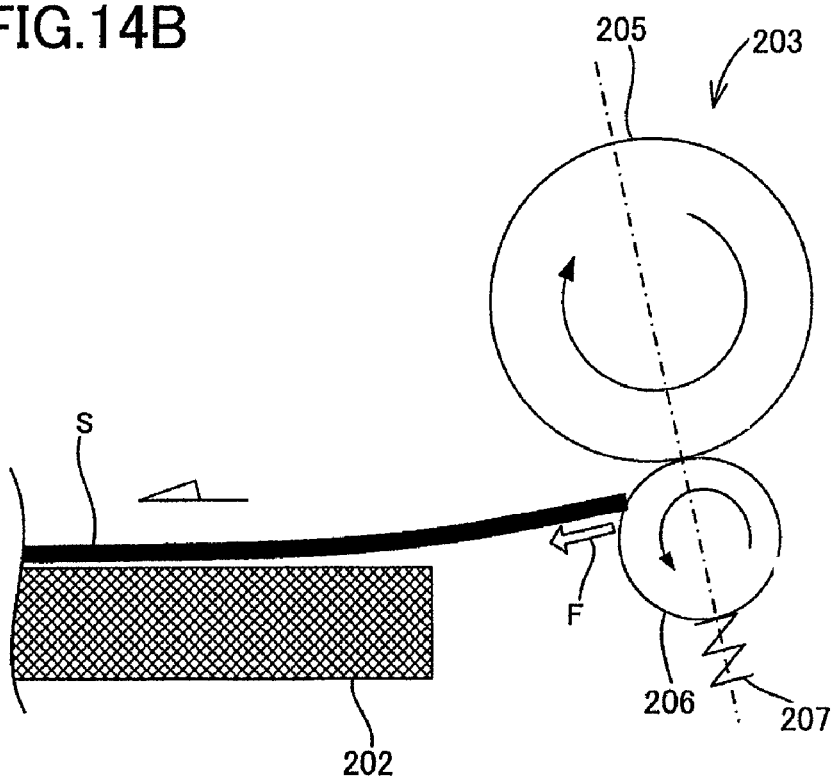

However, with the above-described sheet conveying device 210, as shown in FIG. 14A, immediately after the trailing edge of the recording sheet S separates from the nip portion (pressure portion), the trailing edge contacts the roller surface of the follow roller 206. Hence, if the trailing edge of the recording sheet S contacts the rotating roller surface of the follow roller 206, the recording sheet S receives, from the roller surface, force F (see FIG. 14B) in the same direction as the conveying direction. This force F acts to push the recording sheet S in the conveying direction. If the recording sheet S is pushed by the force F when image recording is performed on the recording sheet S, the recording sheet S is conveyed more than necessary, causing the image recording position to deviate in the conveying direction. As a result, there arises a problem that a phenomenon referred to as "banding" (also referred to as "image jump") is caused, which deteriorates image quality significantly. Especially, in a configuration where the recording sheet is conveyed while being pressed toward the platen 202 from the oblique upper side, partly because the leading edge side of the recording sheet S is nipped by the pair of discharging rollers 204, immediately after the trailing edge separates from the pair of conveying rollers 203, the trailing edge moves-toward the follow roller 206 side due to the restoring force of the warped recording sheet S, and strongly contacts the roller surface. In this case, the above-described phenomenon of banding appears clearly. The above-described phenomenon of banding appears clearly as well, during conveyance of a recording sheet S having relatively large thickness and high rigidity such as a postcard and glossy paper.

Next, a second comparative example will be described. Japanese Patent Application Publication No. 2007-261061 discloses an image recording apparatus provided with conveying means including a pinch roller (48) vertically elastically supported by a pinch roller holder (56). In this image recording apparatus, the pinch roller holder (56) is supported such that the pinch roller holder (56) is movable between a first position and a second position. When the trailing edge of a recording sheet separates from the nip portion between a drive roller (47) and a pinch roller (48), the pinch roller (48) as well as the pinch roller holder (56) moves from the first position to the second position at the upstream side. Further, as shown in FIG. 14 of Japanese Patent Application Publication No. 2007-261061, the pinch roller holder (56) is provided with a guide rib (75) protruding toward a platen (94) side. The guide rib (75) protrudes from the pinch roller (48) toward the platen (94). In the image recording apparatus, after the trailing edge of the recording sheet separates from the nip portion between the drive roller (47) and the pinch roller (48), the trailing edge is supported by the guide rib (75). If the separation distance between the upper end of the guide rib (75) and the outer circumferential surface of the drive roller (47) is large relative to the thickness of the recording sheet, the trailing edge of the recording sheet contacts the roller surface of the pinch roller (48) moving to the second position, immediately after the trailing edge of the recording sheet separates from the nip portion. In this case, even with the image recording apparatus disclosed in Japanese Patent Application Publication No. 2007-261061, the phenomenon of banding is caused. Note that the numerals in parentheses are the numerals used in FIG. 14 of Japanese Patent Application Publication No. 2007-261061. The same goes for the following description.

If the above-described separation distance is set to a small value, the phenomenon of banding can be suppressed. However, with the image recording apparatus of Japanese Patent Application Publication No. 2007-261061, the separation distance cannot be set to a sufficiently small value with the following reasons. Recording sheets that can be recorded by image recording apparatuses include thin recording sheets such as copier paper and thick and rigid recording sheets such as a postcard and glossy paper. In the image recording apparatus of the Japanese Patent Application Publication No. 2007-261061, the guide rib (75) is provided to the pinch roller holder (56). Hence, if the pinch roller (48) is displaced in the elastic direction relative to the pinch roller holder (56), the relative position between the pinch roller (48) and the guide rib (75) changes. With this configuration, if the above-described separation distance is set to a value smaller than the thickness of the recording sheet, the recording sheet cannot pass and hits the guide rib (75), generating problems of conveyance malfunctions such as paper jam and damage of the recording sheet. Accordingly, in the image recording apparatus of Japanese Patent Application Publication No. 2007-261061, the above-described separation distance is set to be adapted to the thickness of the thickest recording sheet. Thus, the separation distance needs to be set to a large value relative to the thickness of a thin recording sheet such as copier paper.

Next, a third comparative example will be described. Similar to the above-described second comparative example, Japanese Patent Application Publication No. 2007-175991 discloses a mechanism that supports a pinch roller holder supporting a pinch roller, such that the pinch roller holder is movable between a first position and a second position. In this mechanism, the pinch roller holder moves to the second position when the trailing edge of a recording sheet separates from the nip portion between a drive roller and a pinch roller. In Japanese Patent Application Publication No. 2007-175991, the second position is set to a position at which the pinch roller is located at the upstream side of the vertical plane passing through the above-described nip portion, that is, a position at which the roller surface of the pinch roller does not intersect the vertical plane. Thus, the trailing edge of the recording sheet does not easily contact the roller surface of the pinch roller when the trailing edge of the recording sheet separates from the nip portion. However, immediately after the trailing edge of the recording sheet separates from the nip portion, the rolling movement of the pinch roller is not performed yet, and trailing edge of the recording sheet instantaneously contacts the roller surface of the pinch roller in some cases. Accordingly, even with the mechanism disclosed in Japanese Patent Application Publication No. 2007-175991, the occurrence of the phenomenon of banding cannot be eliminated. Especially, if the second position is set to the above-described position, the rolling range of the pinch roller holder becomes large, depending on the dimension of the external diameter of the pinch roller. In this case, initial rolling movement of the pinch roller holder cannot be performed quickly, and the trailing edge of the recording sheet contacts the roller surface of the pinch roller frequently. Further, if the second position is set to the above-described position, the enlargement of the rolling range increases the size of the apparatus and, in some cases, the spring force needs to be increased due to the enlargement of the rolling range. In addition, because the nip angle of the nip portion in the horizontal direction increases, there also arises an adverse effect that the sheet supplying path to the nip portion becomes complicated.

The first through third comparative examples have the above-described problems. However, the sheet conveying device and the image recording apparatus according to the embodiment are capable of preventing a recoding medium from being pushed by the follow roller, immediately after the recoding medium separates from the nip portion between the drive roller and the follow roller, thereby improving the quality of an image recorded on the recoding medium.

Next, a fourth comparative example will be described. Japanese Patent Application Publication No. 2007-90669 discloses a recording apparatus that supports a follow roller so that the follow roller can move in the conveying direction and can rotate. When the trailing edge of a recording sheet separates from the nip portion between a drive roller and a follow roller, the follow roller receives force from the trailing edge of the recording sheet and retracts toward the upstream side. More specifically, in the recording apparatus disclosed in Japanese Patent Application Publication No. 2007-90669, a holder supporting the follow roller is supported, via a rolling bearing, by a holder support member fixed to a frame of the apparatus, so that the holder can move. With this arrangement, the holder itself can move in the conveying direction.

In the support mechanism disclosed in Japanese Patent Application Publication No. 2007-90669, a rotational shaft (65) of a pinch roller (48) is positioned by a bearing (63) in order to increase accuracy of rolling movement of a pinch roller holder (56). Accordingly, the looseness of the support section of the rotational shaft (65) can be made smaller, and the force applied from a recording sheet can be transmitted evenly to the pinch roller holder (56) during the rolling movement, thereby achieving rolling movement with high precision. However, in this support mechanism, the rotational shaft (65) is directly supported by the pinch roller holder (56) so that the rotational shaft (65) can move in the up-down direction. Hence, even when a recording sheet enters the nip portion between the drive roller (47) and the pinch roller (48), causing the pinch roller (48) to move in the up-down direction, the pinch roller holder (56) does not move. That is, only the pinch roller (48) can move in the up-down direction, which causes the problem described below. Note that the numerals in parentheses are the numerals used in FIG. 7 of Japanese Patent Application Publication No. 2007-90669. The same goes for the following description.

Figure 7:
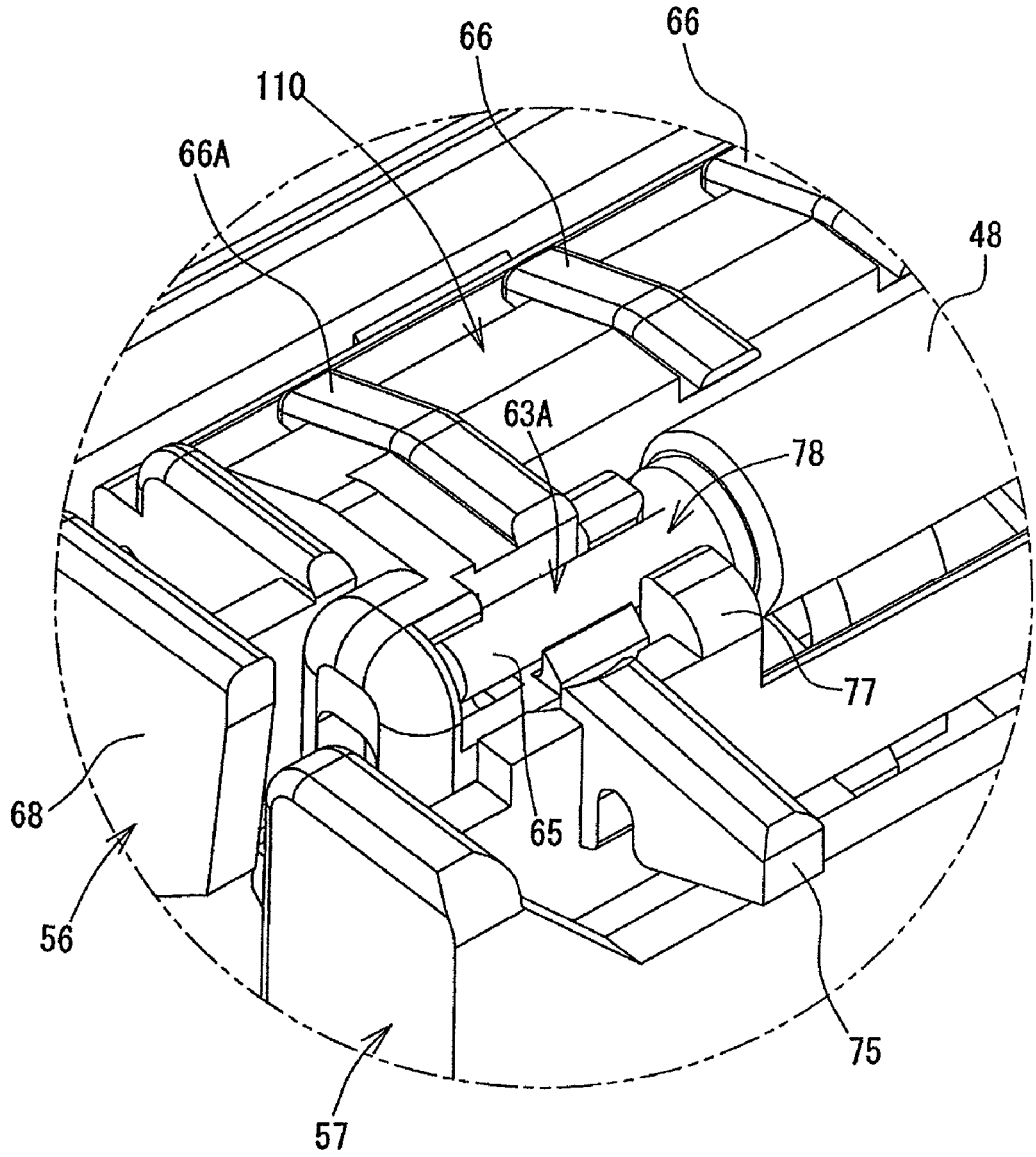
FIG. 7 is an enlarged perspective view showing a support section of a rotational shaft of a pinch roller.

In the above-described support mechanism shown in FIG. 7 of Japanese Patent Application Publication No. 2007-90669, a holder support member (57) is attached to the main frame, and a rolling bearing (80) is provided on the support surface (upper surface) of the holder support member (57). The pinch roller holder (56) is attached to the further upper side of the rolling bearing (80), and the rotational shaft (65) of the pinch roller (48) is rotatably supported by the pinch roller holder (56) via a coil spring (61). In this support mechanism, because a plurality of members stand between the holder support member (57) and the pinch roller (48), the accumulated dimension tolerances of each member cause variances (errors) in the height from the pinch roller (48) to the pinch roller holder (56). If the minimum values of dimension tolerances of each member are accumulated, the height from the pinch roller (48) to the pinch roller holder (56) becomes the maximum, causing the pinch roller (48) to be exposed greatly from the pinch roller holder (56) toward the drive roller (47) side. In this case, the leading edge of a recording sheet conveyed toward the nip portion between the drive roller (47) and the pinch roller (48) contacts the roller surface of the pinch roller (48) at a position away from the nip portion. Depending on the degree of exposure of the pinch roller (48), the recording sheet may enter and contact the roller surface of the pinch roller (48) at an approximately right angle. In this case, the recording sheet cannot enter the nip portion smoothly, which causes paper jam before the nip portion.

In contrast, if the maximum values of dimension tolerances of each member from the holder support member (57) to the pinch roller (48) are accumulated, the height from the pinch roller (48) to the pinch roller holder (56) becomes the minimum. In other words, the distance between the pinch roller (48) and the drive roller (47) becomes the minimum. In this case, there may arise a problem that the above-mentioned distance becomes smaller than the maximum thickness of a recording sheet that can be conveyed by the device and, for example, a thick recording sheet such as a postcard and glossy paper cannot pass the nip portion.

The fourth comparative example has the above-described problems. However, the sheet conveying device and the image recording apparatus according to the embodiment are capable of guiding a recording sheet so that the recording sheet smoothly passes the nip portion between the drive roller and the follow roller, thereby preventing conveyance malfunctions such as paper jam and oblique conveyance, without preventing a normal rolling movement of the first support member (the pinch roller holder 56), in a mechanism where a plurality of members supports the follow roller.

What is claimed is:

1. A sheet conveying device that conveys a sheet-like recording medium in a predetermined conveying direction, comprising:

a first conveying section having a drive roller and a follow roller arranged in confrontation with the drive roller and configured to followingly rotate while pressed against the drive roller;

a rotation support member that rotatably supports the follow roller;

a guide member provided integrally to the rotation support member, the guide member guiding a recording medium so that the recording medium passes through a nip portion between the drive roller and the follow roller;

a first support member that movably supports the rotation support member so that the follow roller can move toward and away from the drive roller;

a positioning member provided integrally to the first support member, the positioning member positioning a shaft of the follow roller with respect to the conveying direction;

an urging member that is disposed between the first support member and the rotation support member, and that urges the rotation support member toward the drive roller side; and a second support member that supports the first support member so that the first support member is movable between a predetermined first position and a second position at an upstream side of the first position in a conveying direction of the recording medium, the first support member being moved to the first position during conveyance of the recording medium by the first conveying section, the first support member being moved to the second position during non-conveyance of the recording medium by the first conveying section.

2. The sheet conveying device according to claim 1, wherein the positioning member comprises:

at least two support ribs protruding from the first support member and arranged with an interval therebetween in an axial direction of the drive roller; and a groove formed at a protruding end of the at least two support ribs, the shaft of the follow roller being inserted in the groove.

3. The sheet conveying device according to claim 1, wherein the guide member is provided to an upper surface of the rotation support member at an upstream side in the conveying direction, thereby guiding a recording medium to the nip portion.

4. The sheet conveying device according to claim 1, further comprising a second conveying section that is provided away from the first conveying section at a downstream side in the conveying direction, the second conveying section conveying a recording medium conveyed by the first conveying section toward a further downstream side in the conveying direction.

5. The sheet conveying device according to claim 1, wherein the second support member comprises:

a support surface that supports the first support member;

a first restricting member that restricts rolling movement of the first support member at the first position; and a second restricting member that restricts rolling movement of the first support member at the second position, wherein the second support member movably supports the first support member via a movement support unit, and wherein the movement support unit comprises:

a plurality of concave sections formed in the support surface of the second support member;

a rotating body accommodated in the plurality of concave sections; and a supported section of the first support member that makes contact with a circumferential surface of the rotating body, when the first support member is supported by the second support member in a state where the rotating body is accommodated in the plurality of concave sections.

6. The sheet conveying device according to claim 1, wherein the second support member supports the first support member, such that the first support member separates away from the drive roller as the first support member moves from the first position to the second position, wherein the second support member causes the first support member to move around a revolution center line as a center, the revolution center line being in parallel with an axis of the drive roller, wherein the revolution center line is located at the second position side of a plane including: the axis of the drive roller; and an axis of the follow roller when the first support member is located at the first position, and wherein the support surface of the second support member substantially corresponds to an outer circumferential surface of a predetermined cylinder drawn around the revolution center line as a center.

7. An image recording apparatus, comprising:

a sheet conveying device that conveys a sheet-like recording medium in a predetermined conveying direction, comprising:

a first conveying section having a drive roller and a follow roller arranged in confrontation with the drive roller and configured to followingly rotate while pressed against the drive roller;

a rotation support member that rotatably supports the follow roller;

a guide member provided integrally to the rotation support member, the guide member guiding a recording medium so that the recording medium passes through a nip portion between the drive roller and the follow roller;

a first support member that movably supports the rotation support member so that the follow roller can move toward and away from the drive roller;

a positioning member provided integrally to the first support member, the positioning member positioning a shaft of the follow roller with respect to the conveying direction;

an urging member that is disposed between the first support member and the rotation support member, and that urges the rotation support member toward the drive roller side; and a second support member that supports the first support member so that the first support member is movable between a predetermined first position and a second position at an upstream side of the first position in a conveying direction of the recording medium, the first support member being moved to the first position during conveyance of the recording medium by the first conveying section, the first support member being moved to the second position during non-conveyance of the recording medium by the first conveying section; and a recording head that performs image recording by an inkjet recording method onto a recording medium that is conveyed by the sheet conveying device.

* * * * *